US008123339B2

(12) United States Patent
Mori et al.

(10) Patent No.: US 8,123,339 B2
(45) Date of Patent: Feb. 28, 2012

(54) LIQUID EJECTION HEAD AND IMAGE FORMING APPARATUS USING THE SAME

(75) Inventors: Naoko Mori, Atsugi (JP); Takahiro Yoshida, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 872 days.

(21) Appl. No.: 11/901,067

(22) Filed: Sep. 14, 2007

(65) Prior Publication Data

US 2008/0117262 A1 May 22, 2008

(30) Foreign Application Priority Data

Sep. 15, 2006 (JP) ..... 2006-250488
Jul. 23, 2007 (JP) ..... 2007-191276

(51) Int. Cl.
*B41J 2/045* (2006.01)

(52) U.S. Cl. ..... 347/71

(58) Field of Classification Search ..... 347/71
See application file for complete search history.

(56) References Cited

U.S. PATENT DOCUMENTS 6,361,155 B1 3/2002 Kanda et al.
2002/0036678 A1 3/2002 Ito et al.

FOREIGN PATENT DOCUMENTS

EP 1099556 A2 5/2001
JP 8-174825 7/1996
JP 2001-30483 2/2001
JP 2001-322271 11/2001
JP 2002-52723 2/2002
JP 2002-248769 9/2002
JP 2004-74582 3/2004

OTHER PUBLICATIONS

Dec. 21, 2007 European search report in connection with corresponding European patent application No. EP 07 25 3644.
Feb. 10, 2011 European official action in connection with counterpart European patent application No. 07 253 644.

*Primary Examiner* — Jerry Rahll
(74) *Attorney, Agent, or Firm* — Cooper & Dunham LLP

(57) ABSTRACT

A liquid ejection head includes a plurality of orifices, a plurality of chambers in communication with the orifices, a plurality of fluid resistance portions in communication with the chambers, a plurality of liquid passages each including at least one of the chambers and at least one of the fluid resistance portions, a plurality of passage groups each including adjacent ones of the liquid passages, and a plurality of first partitions and a plurality of second partitions. The orifices eject droplets of liquid. The fluid resistance portions each are narrower than the chambers. Each of the first partitions, provided with a void, separates adjacent ones of the liquid passages. Each of the second partitions, which is not provided with the void, separates adjacent ones of the passage groups. The liquid ejection head is capable of recording a high-quality image with an increased density of liquid passages and nozzle orifices.

11 Claims, 20 Drawing Sheets

LIQUID EJECTION HEAD AND IMAGE FORMING APPARATUS USING THE SAME

TECHNICAL FIELD

The present disclosure relates generally to a liquid ejection head and an image forming apparatus using the same, and more specifically, to a liquid ejection head capable of recording a high-quality image with an increased density of liquid passages and nozzle orifices and an image forming apparatus using the same.

DISCUSSION OF RELATED ART

An image forming apparatus used as a printer, facsimile machine, copier, plotter, or multi-functional device thereof may have a liquid ejection device including a liquid ejection head or recording head. Such an image forming apparatus ejects droplets of recording liquid from the liquid ejection head to form a desired image on a sheet.

The term "sheet" used herein refers to a medium, a recording medium, a recorded medium, a sheet material, a transfer material, a recording sheet, a paper sheet, or the like. The sheet may also be made of material such as paper, string, fiber, cloth, leather, metal, plastic, glass, timber, and ceramic. Further, the term "image formation" used herein refers to providing, recording, printing, or imaging an image, a letter, a figure, a pattern, or the like onto the sheet. Moreover, the term "liquid" used herein is not limited to recording liquid or ink, and may include anything ejected in the form of a fluid. Hereinafter, such liquid may be simply referred to as "ink". Furthermore, the term "liquid ejection device" refers to a device ejecting liquid from a liquid ejection head to form an image, a letter, a figure, a pattern, or the like.

Several different types of liquid ejection heads are known. Certain liquid ejection heads typically include the following elements: nozzle orifices to eject liquid droplets having diameters of from several micrometers to tens of micrometers; a chamber in connection with the orifices; and a vibration plate forming a wall surface of the chamber. The liquid ejection head further includes, for example, a piezoelectric actuator, such as a piezoelectric element, to apply pressure to liquid in the chamber via the vibration plate.

Alternatively, other liquid ejection heads further include a thermal actuator to apply pressure to the liquid in the chamber. Such a thermal actuator uses an electricity-to-heat conversion element to generate film boiling and thus a phase change of the liquid.

Still another type of liquid ejection head further includes an electrostatic actuator to apply pressure to liquid in the chamber by electrostatically generating displacement of the vibration plate.

Such liquid ejection heads as those described above typically include a passage plate in which a liquid passage is formed. Such a liquid passage typically includes a chamber and a fluid resistance portion having a smaller width than the width of the chamber and serving as a liquid flow path for supplying the liquid to the chamber.

Several methods of forming such a passage plate are known. For example, a passage plate may be formed by bonding a plurality of metal plates with adhesive agent, performing anisotropic etching on a silicon single crystal substrate, etching a metal plate such as SUS (stainless used steel), or electroforming.

For example, when a passage plate is formed by electroforming, a pattern is formed on an electroforming support substrate (or electrode substrate) with a non-conductive resist to deposit a coating film. Such non-conductive resist may shield some area of the substrate during electroforming. However, the larger the resist shielding area, the more the electric field of the area concentrates around an electrode provided at one end portion of the resist. Such electric field concentration may increase a thickness of the coating film formed around the electrode, and thus the passage plate may be formed in an uneven thickness.

Such variation in thickness may not pose a serious drawback in a plate member such as a nozzle orifice plate having a relatively small shield area. However, for a plate member such as a vibration plate having a relatively minute shield pattern, such variation in the thickness of the plate member may have an undesirable effect on the minute shield pattern.

Such variation in thickness may also have an undesirable effect when the vibration plate is bonded to an actuator such as a piezoelectric element. When a plate member has such uneven thickness, in order to appropriately bond a vibration plate and an actuator together, an adhesive layer should be formed that is thicker than the amount of variation in the thickness of the plate member. Here, the amount of variation in the thickness refers to the difference between the lowest and highest portions of a surface of the plate member.

For example, when the amount of variation in the thickness of the plate member is 10 μm, the thickness of the adhesive layer should be more than 10 μm. At the same time, however, an increase in the amount of adhesive may result in an overflow from the bonding surface between a vibration plate and an actuator at a relatively thick portion of the vibration plate.

Consequently, when a minute passage pattern is formed in the vibration plate, the excess adhesive overflowing from a passage area may contact an adjacent passage area and/or flow over a deformable portion of the vibration plate.

Generally, the fluid resistance portion forming a passage is smaller in height and/or width than a corresponding chamber. Thus, an overflow of adhesive into a fluid resistance portion may have an undesirable effect on the liquid ejection performance from a recording head, which may further cause ejection failure.

In order to prevent overflow of adhesive into such a fluid resistance portion, for example, one type of conventional liquid ejection head includes a passage member in which a fluid resistance portion is formed thinner than a chamber.

In another type of conventional liquid ejection head, a fluid resistance portion is formed of a plurality of plate members. Thus, the fluid resistance portion is configured so that the fluid resistance thereof is adjustable by changing the height and width of a passage including the fluid resistance portion.

For a conventional passage pattern, as illustrated in FIG. 1, one passage 500 includes a pressure chamber 501, a fluid resistance portion 502 serving as a liquid supply port for supplying liquid to the pressure chamber 501, and a liquid inflow portion 503. A plurality of passages 500 are arrayed at a given pitch in the direction in which nozzle orifices are arranged.

In such a configuration, between adjacent passages 500, the width (in the direction in which the passages 500 are arrayed) of a partition (hereinafter, "chamber partition") 511 separating adjacent pressure chambers 501 is different from the width of a partition (hereinafter, "resistance partition") 512 separating adjacent fluid resistance portions 502.

Thus, when a passage plate is formed by electroforming, the current density of a surrounding portion of each chamber 501 may significantly differ from the current density of a surrounding portion of each fluid resistance portion 502. Such a difference in the current density may cause a variation in the thickness of a coating film formed by electroforming. Consequently, a variation in height may be caused between the chamber partition 511 and the resistance partition 512.

Alternatively, although a passage plate can be formed by pressing or etching instead of electroforming, the width of the chamber partition 511 may be formed smaller than the width of the resistance partition 512. As a result, an adhesive agent may overflow into the fluid resistance portion 502 in greater amounts, which may cause failure in ejecting liquid droplets.

In order to accept such adhesive overflow, a void such as a hole or concavity might be provided in the resistance partition 512. However, in such a passage pattern as illustrated in FIG. 1, the width of the resistance partition 512 may need to be set relatively small in order to array orifices in relatively high density. Therefore, such a configuration may require a higher level of manufacturing technique or skill, which may not be actually implemented for forming such void in the resistance partition 512. Further, even if such void can be formed in the resistance partition 512, a relatively severe dimensional limitation may be imposed on the void formation in the resistance partition 512, which may result in lower liquid-ejection performance.

BRIEF SUMMARY

In an aspect of this disclosure, there is provided a liquid ejection head capable of recording a high-quality image with an increased density of liquid passages and nozzle orifices.

In another aspect, a liquid ejection head includes a plurality of orifices, a plurality of chambers in communication with the plurality of orifices, a plurality of fluid resistance portions in communication with the plurality of chambers, a plurality of liquid passages each including at least one of the plurality of chambers and at least one of the plurality of fluid resistance portions, a plurality of passage groups each including at least two adjacent ones of the plurality of liquid passages, and a plurality of first partitions and a plurality of second partitions. The plurality of orifices eject droplets of liquid. The plurality of fluid resistance portions each are narrower than the chambers. Each of the first partitions, provided with a void, separates adjacent ones of the plurality of liquid passages. Each of the second partitions, which is not provided with the void, separates adjacent ones of the plurality of passage groups.

Additional aspects, features and advantages will be more fully apparent from the following detailed description, the accompanying drawings, and the associated claims.

BRIEF DESCRIPTION OF THE DRAWINGS

A more complete appreciation of the subject matter of this disclosure and many of the attendant advantages thereof will be readily obtained as the same becomes better understood by reference to the following detailed description when considered in connection with the accompanying drawings, wherein.

Figure 1:
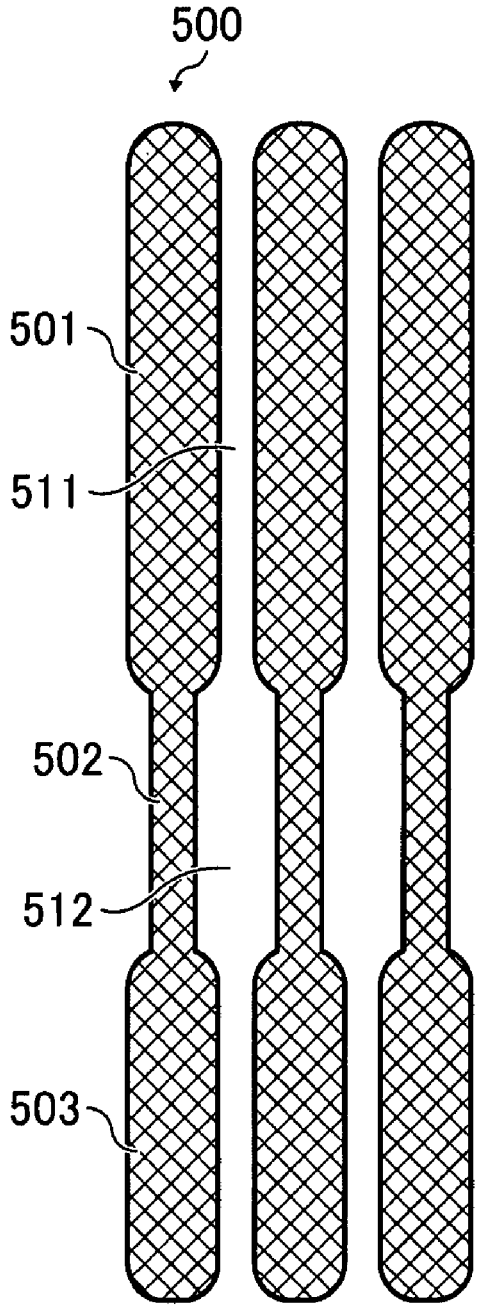
FIG. 1 RELATED ART
FIG. 1 is a plan view illustrating a passage pattern of a conventional liquid ejection head.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like may be used herein to facilitate description of one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors herein interpreted accordingly.

Although the terms first, second, etc., may be used herein to describe various elements, components, regions, layers, and/or sections, it should be understood that these elements, components, regions, layers, and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to limit the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. For the sake of simplicity, the same reference numerals are used in the drawings and the descriptions for the same materials and constituent parts having the same functions, and descriptions thereof are omitted unless otherwise stated.

Exemplary embodiments of the present disclosure are now described below with reference to the accompanying drawings. It should be noted that, in a later-described comparative example, exemplary embodiment, and alternative example, the same reference numerals are used for the same constituent elements such as parts and materials having the same functions, and descriptions thereof omitted.

First, a liquid ejection head according to an exemplary embodiment of the present disclosure is described with reference to FIGS. 2 through 5.

Figure 2:
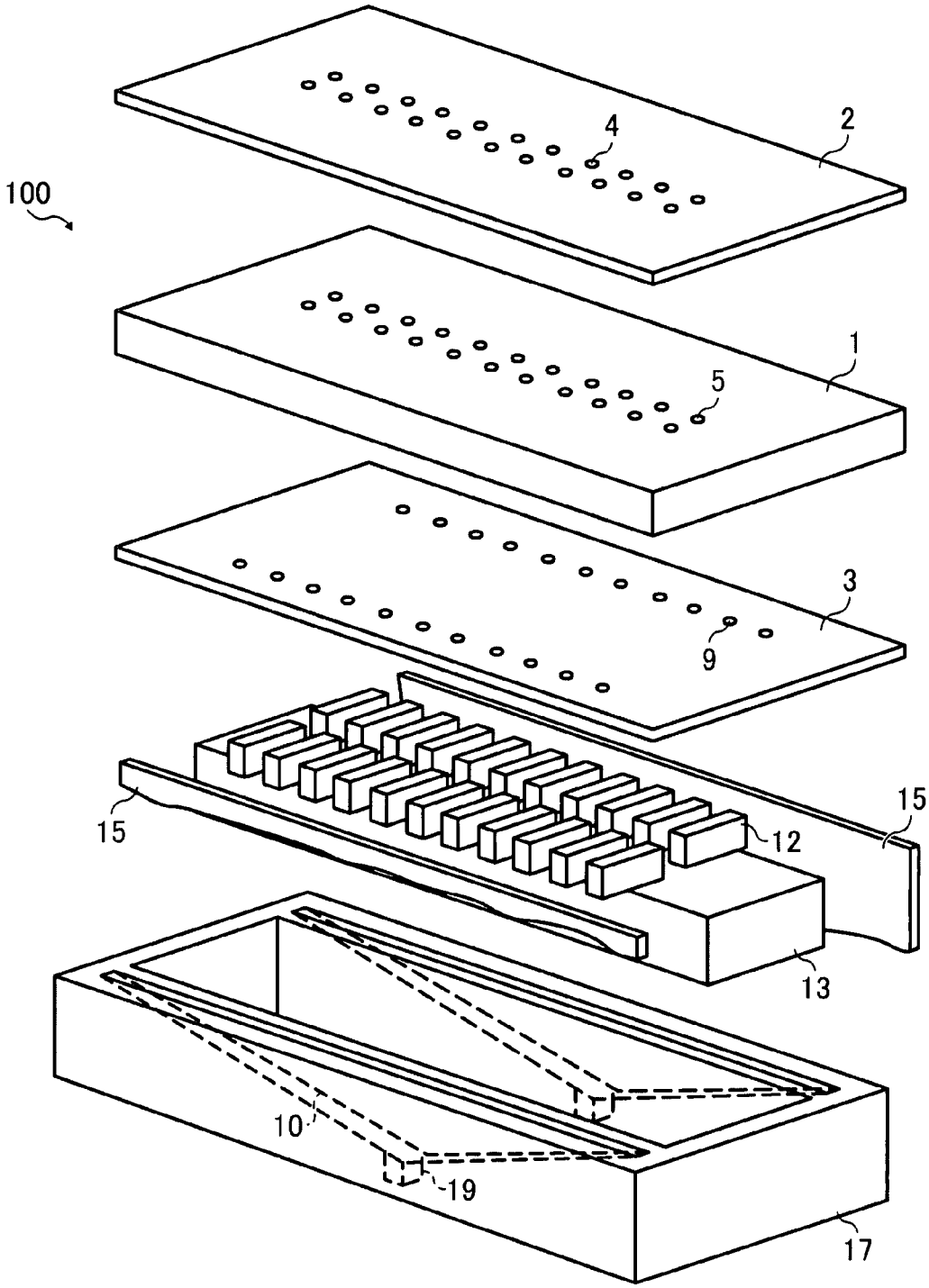
FIG. 2 is an exploded perspective view of a liquid ejection head according to an exemplary embodiment of the present disclosure.
Figure 3:
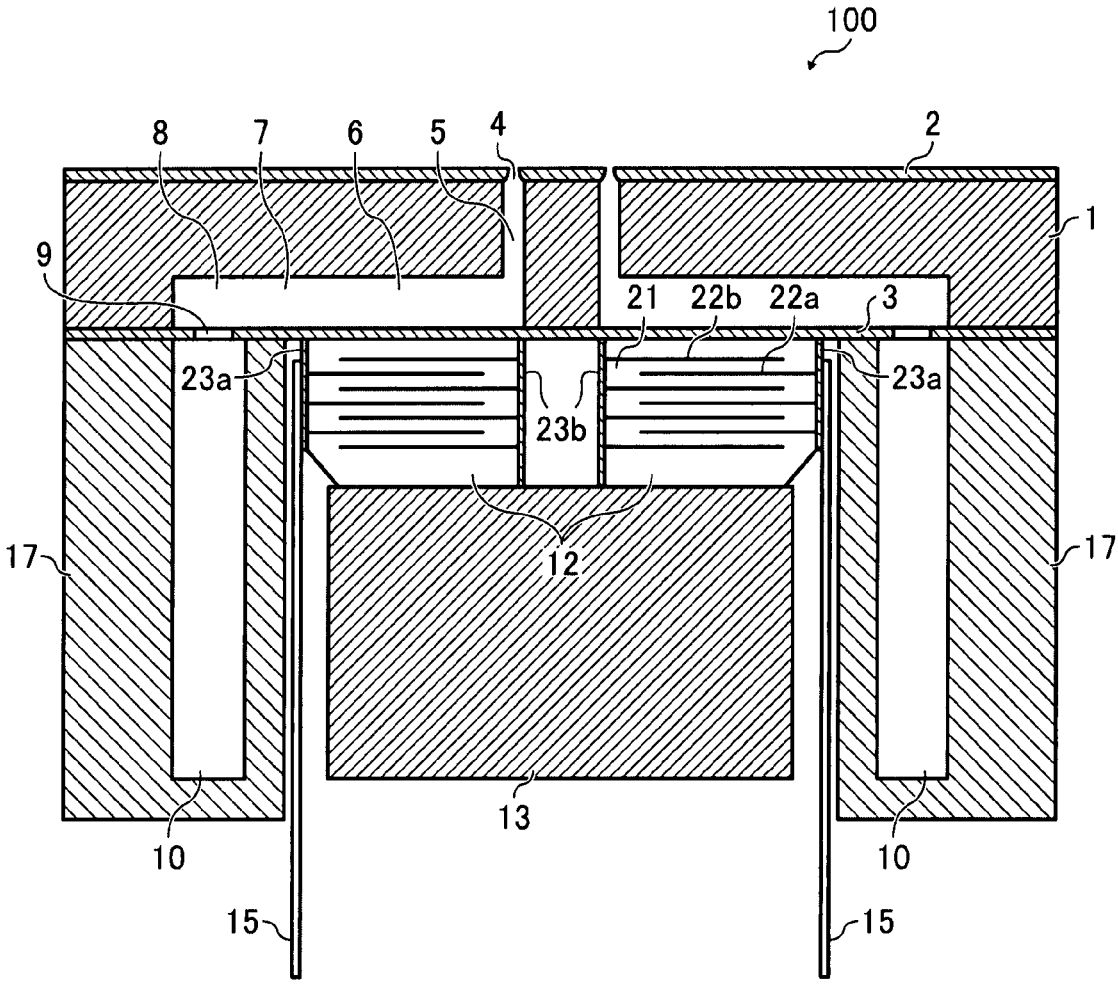
FIG. 3 is a cross-sectional view of the liquid ejection head of FIG. 2, taken along a long direction of a pressure chamber provided therein.
Figure 4:
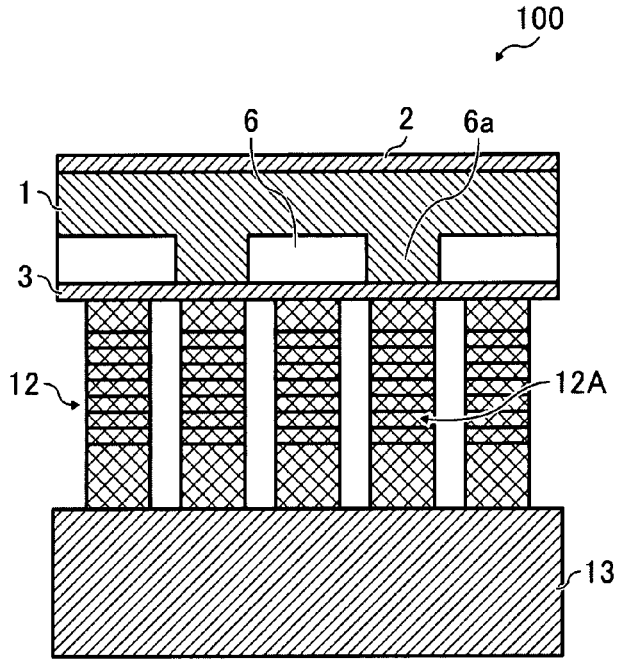
FIG. 4 is a cross-sectional view illustrating a bi-pitch structure of the liquid ejection head of FIG. 2, taken along a short direction of the pressure chamber.
Figure 5:
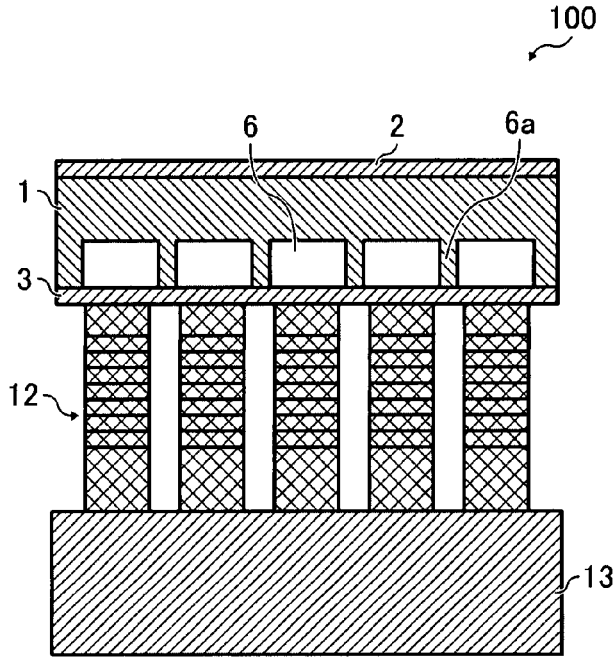
FIG. 5 is a cross-sectional view illustrating a normal pitch structure of the liquid ejection head of FIG. 2, taken along a short direction of a pressure chamber.

FIG. 2 is an exploded perspective view of a liquid ejection head according to an exemplary embodiment of the present disclosure. FIG. 3 is a cross-sectional view of the liquid ejection head of FIG. 2, taken along a long direction of a pressure chamber provided therein. FIG. 4 is a cross-sectional view illustrating a bi-pitch structure of the liquid ejection head of FIG. 2, taken along a short direction of the pressure chamber. FIG. 5 is a cross-sectional view illustrating a normal-pitch structure of the liquid ejection head of FIG. 2, taken along a short direction of the pressure chamber.

As illustrated in FIGS. 2 through 5, a liquid ejection head 100 typically includes a passage plate 1, an orifice plate 2, a vibration plate 3, piezoelectric elements 12, a base member 13, FPC (flexible printed circuit) cables 15, and a frame member 17.

The passage plate 1 is made of metal and serves as a passage forming member in which liquid passages including communication paths 5, pressure chambers 6, fluid resistance portions 7, and inflow portions 8 are typically formed.

The orifice plate 2 is made of metal and serves as an orifice forming member in which orifices 4 are formed. The orifice plate 2 is also coupled to an upper surface of the passage plate 1.

The vibration plate 3 is made of metal and is coupled to an undersurface of the passage plate 1 so as to form a wall surface of each pressure chamber 6.

The pressure chambers 6, the flow resistance portions 7, and the inflow portions 8 are formed by the passage plate 1, the orifice plate 2, and the vibration plate 3. The orifices 4 through which droplets are ejected are in communication with corresponding pressure chambers 6 via the communication paths 5. The inflow portions 8 are in communication with the corresponding pressure chambers 6 via the fluid resistance portions 7. Liquid, e.g. ink, is stored in common chambers 10 that are formed in the frame member 17, described later, and is supplied to the respective inflow portions 8 through corresponding supply openings 9 that are formed in the vibration plate 3.

As illustrated in FIG. 3, the upper surfaces of laminated-type piezoelectric elements 12 serving as driving elements (actuators or pressure generators) are joined to the undersurface of the vibration plate 3 via connectors, not illustrated, formed at the vibration plate 3. Thus, the piezoelectric elements 12 are disposed below the corresponding pressure chambers 6. Further, the undersurfaces of the piezoelectric elements 12 are joined to the base member 13.

Each piezoelectric element 12 includes a piezoelectric material layer 21, an internal electrode 22*a*, and an internal electrode 22*b*. The internal electrodes 22*a* and 22*b* are alternately laminated via the piezoelectric material layer 21. One end of the internal electrode 22*a* is extended to one side of the piezoelectric element 12 and is connected to a side electrode (external electrode) 23*a*, and one end of the internal electrode 22*b* is extended to another side of the piezoelectric element 12 and is connected to a side electrode 23*b*. By applying a voltage between the side electrodes 23*a* and 23*b*, the piezoelectric element 12 is displaced in a direction in which the internal electrodes 22*a* and 22*b* are laminated.

In order to transmit driving signals to the piezoelectric elements 12, the FPC cables 15 are connected to the piezoelectric elements 12 by solder bonding, ACF (anisotropic conductive film) bonding, or wire bonding. The FPC cables 15 are provided with a driving circuit or driving IC (integrated circuit), not illustrated, to selectively apply a drive pulse to each piezoelectric element 12.

As illustrated in FIG. 4, the liquid ejection head 100 may have what is called a "bi-pitch" structure, in which piezoelectric elements 12 and pillars 12A are alternately arranged in a latitudinal direction of the pressure chambers 6, that is, the direction in which the orifices 4 are arrayed (hereinafter also referred to as the orifice array direction). Here, the piezoelectric elements 12 are located under the corresponding pressure chambers 6, while the pillars 12A are located below partition portions 6*a* between the pressure chambers 6. The piezoelectric elements 12 and the pillars 12A are substantially identical in configuration. However, the pillars 12A merely serve as support members because no driving voltage is applied thereto.

Alternatively, as illustrated in FIG. 5, the liquid ejection head 100 may have what is called a "normal pitch" structure, in which no such pillars 12A are provided and the piezoelectric elements 12 are located under the corresponding pressure chambers 6.

In the liquid ejection head 100, the displacement of the piezoelectric elements 12 is generated in a given direction, thereby applying pressure to the ink in the pressure chambers 6.

Further, the liquid ejection head 100 ejects liquid droplets according to a side shooting method. In the side shooting method, the direction in which a recording liquid is ejected as liquid droplets is different from the direction in which the recording liquid flows through the pressure chamber 6 (hereinafter, may be referred to as "liquid flow direction"). Where such a side shooting method is used, the size of liquid ejection head may significantly depend on the size of piezoelectric element. Accordingly, the miniaturization of the piezoelectric elements 12 may directly result in and facilitate the miniaturization of the liquid ejection head 100.

The frame member 17 is joined to the outside of an actuator unit including the piezoelectric elements 12, the base member 13, and the FPC cables 15. The frame member 17 is made of epoxy system resin or polyphenylene sulphite and is formed by injection molding. In the frame member 17, the common chambers 10 are formed together with corresponding supply ports 19. Each supply port 19 is connected to an external liquid source, such as a sub-reservoir and a recording liquid cartridge, not illustrated, for supplying a recording liquid from the external liquid source to the corresponding common chamber 10.

The passage plate 1, the orifice plate 2, and the vibration plate 3 are formed by nickel electroforming. The passage plate 1 has a groove section including penetration holes serving as the communication paths 5, the pressure chambers 6, the fluid resistance portions 7, and the inflow portions 8. The pressure chambers 6 are separated from each other by the partition portions 6*a*.

The orifice plate 2 has nozzle orifices serving as the orifices 4. Each orifice 4 is formed to have a diameter of, for example, approximately 10 μm to approximately 35 μm. The orifice plate 2 is joined to the passage plate 1 with an adhesive. The liquid ejection surface of the orifice plate 2 on the side opposite the side of the pressure chamber 6 is subjected to water-repellent processing.

The vibration plate 3 has thin portions corresponding to the pressure chambers 6 to facilitate deformation thereof. At the central portions of respective thin portions, connectors (not illustrated) are provided to join the piezoelectric elements 12.

To produce the piezoelectric elements 12, a laminated-type piezoelectric-element member coupled to the base member 13 is grooved with a dicing saw, for example, and divided into individual piezoelectric elements 12.

For the bi-pitch structure as illustrated in FIG. 4, similar to the piezoelectric element 12, the pillars 12A are produced from the laminated-type piezoelectric-element member by the groove forming process. However, the pillars 12A merely serve as support members because no driving voltage is applied thereto.

The liquid ejection head 100 thus constructed may be driven according to any suitable driving method, for example, by what is called a "push-ejection" method. In such a push-ejection method, a control unit, not illustrated, selectively applies a driving pulse having a voltage of from 20 V to 50 V to an appropriate piezoelectric element 12 according to an image to be recorded. The driving pulse causes displacement of the piezoelectric element 12 and the vibration plate 3 is deformed toward the orifice plate 2. Further, the volume of the pressure chamber 6 is changed so that pressure is applied to the liquid in the pressure chamber 6. As a result, the liquid is ejected as droplets from the orifices 4 of the orifice plate 2. Such liquid ejection reduces the pressure in the pressure chamber 6, thereby generating a flow of the liquid into the pressure chamber 6. The inertia of the liquid flow further generates a slight amount of negative pressure in the pressure chamber 6.

In this condition, when the application of the driving signal voltage to the piezoelectric element 12 is stopped, the vibration plate 3 returns to its original position and thus the pressure chamber 6 returns to its original shape, generating additional negative pressure therein that refills the pressure chamber 6 with additional liquid supplied from the corresponding common chamber 10 and prepares for a subsequent ejecting operation of liquid in response to a subsequent driving pulse.

Alternatively, the liquid ejection head 100 may be driven according to what is called a "pull-and-release ejection" method. In the pull-and-release ejection method, the vibration plate 3 is pulled and then released to apply pressure to the liquid in the pressure chamber 6. Such a pull-and-release ejection method utilizes the restoring force of the vibration plate 3 to eject a liquid droplet from the liquid ejection head 100.

Further, the liquid ejection head 100 may be driven according to what is called a "pull-and-push ejection" method. In such a method, the vibration plate 3 is pulled and then is positively pushed to apply pressure to the liquid in the pressure chamber 6.

Figure 6:
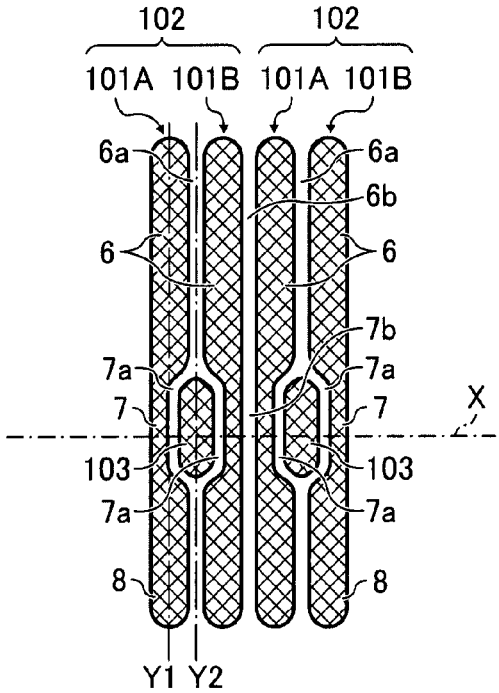
FIG. 6 is a plan view illustrating a passage pattern formed in a passage plate (or passage-forming member) of a liquid ejection head according to another exemplary embodiment of the present disclosure.

Next, a liquid ejection head according to another exemplary embodiment of the present disclosure is described with reference to FIG. 6. FIG. 6 is a plan view illustrating a passage pattern formed at a passage plate (or passage plate member) of the liquid ejection head.

As illustrated in FIG. 6, a liquid ejection head 100 includes passages 101A and 101B. Each of the passages 101A and 101B typically includes a pressure chamber 6 being in communication with orifices 4, a fluid resistance portion 7 having a width smaller than the width of the pressure chamber 6, and an inflow portion 8.

Here, the width of the pressure chamber 6 refers to the length thereof in the orifice array direction of a passage plate 1. Hereinafter, the width of the pressure chamber 6 is used in the same manner unless explicitly noted.

The two adjacent passages 101A and 101B form one passage group 102. In the passage plate 1, a given number of passages 101A and 101B are arranged in the orifice array direction to form a plurality of the passage groups 102 as illustrated in FIG. 6. It should be noted that although only the two passage groups 102 are illustrated in FIG. 6, in actuality any suitable number of the passage groups 102 may be arranged corresponding to the number of orifices 4. This point similarly applies to the drawings described herein below.

In the liquid ejection head 100, the pitch between the adjacent pressure chambers 6 of each passage group 102 is set to be substantially equal to the pitch between the adjacent pressure chambers 6 of the adjacent passage groups 102.

As illustrated in FIG. 6, the fluid resistance portion 7 of each passage 101A is disposed to the left side thereof, and the fluid resistance portion 7 of each passage 101B is disposed to the right side thereof. Thus, a relatively wide partition portion 7*a* is provided between the two fluid resistance portions 7.

A void 103 is formed in each partition portion 7*a* but no such void 103 is formed in the partition portion 7*b* between the two adjacent passage groups 102. The void 103 may be a penetration hole passing through the thickness of the passage forming member. Alternatively, the void 103 may be a blind hole or a concavity having a bottom surface inside the passage forming member. Further, the void 103 may be formed in any other suitable shape besides those described herein.

The widths of the partition portions 6*a*, 6*b*, 7*a*, and 7*b* are set to be substantially identical. Further, the partition portion 6*b* and the partition portion 7*b* form a linear shape together as illustrated in FIG. 6, which shows a plan view.

For this configuration, as illustrated in FIG. 6, the fluid resistance portions 7, the partition portions 7*a* having the voids 103 formed by penetrating or partially removing the passage plate member, and the partition portions 7*b* not having the voids 103 are arrayed on a line X-X extending in the direction in which the plurality of passages are arrayed (hereinafter also referred to as "passage array direction").

The passage patterns according to the later-described exemplary embodiments illustrated in FIG. 7 through FIG. 20 have a similar configuration along a line X-X as illustrated in FIG. 6, and thus the illustration and description of the line X-X are omitted hereinafter for simplicity.

As described above, the partition portions separating the fluid resistance portions 7 include the partition portion 7*a* having the void 103 and the partition portion 7*b* not having the void 103.

The above-described configuration provides a liquid ejection head with a higher-density passage group and a void that is formed between the fluid resistance portions of each passage group so as to adjust the width of partition portion and/or receive an overflow of excess adhesive.

Further, as described above, the adjacent passages form one passage group. In the passage plate, a given number of passages are arrayed in the orifice array direction to form a plurality of the passage groups. The partition portion between the adjacent passages of each passage group is provided with a void whereas the partition portion between the adjacent passage groups is provided without the void.

In such a configuration, even when orifices and pressure chambers are arranged in relatively high density, the width of the partition portion between the adjacent fluid resistance portions of each passage group is adjustable so that the void may be formed in the partition portion and accommodate adhesive overflow to prevent bonding failure of the passage plate.

At the same time, the width of the partition portion between the fluid resistance portions is set equal to the width of the partition portion between the pressure chambers. Thus, a relatively high density is obtained for the passages of liquid ejection head.

As described above, a void is formed between the adjacent fluid resistance portions of each passage group whereas such a void is not formed between the adjacent fluid resistance portions of the adjacent passage groups. Accordingly, the respective passages of each passage group have different shapes.

Further, the pitch between the adjacent pressure chambers of the single passage group is set to be equal to the pitch between the adjacent pressure chambers of the adjacent passage groups. Thus, a relatively high-density arrangement may be obtained for the passages, and the circumference portions of passages may be formed to have a substantially identical width.

Such a configuration provides a uniform electric-field distribution around passages when the passages are formed by electroforming, etching, or any other suitable manufacturing method.

Further, such a configuration reduces unevenness in height between the partition portions formed by electroforming or the like.

Furthermore, as described above, the pitch between the adjacent pressure chambers of each passage group is set to be equal to the pitch between the adjacent pressure chambers of the adjacent passage groups. As a result, mutual interference that might be generated between the adjacent pressure chambers is effectively dispersed. Thus, a uniform ejection property may be obtained for the liquid droplets ejected from the pressure chambers.

As described above, in this configuration, a void is formed between the fluid resistance portions of each passage group. In other words, a void is formed at the partition portion between the fluid resistance portions, in which the cross-sectional areas of the respective passages are relatively small and the width of the partition portion therebetween is relatively great. Thus, even when the passages are arranged in relatively high density, space in which the void is to be formed can still be obtained.

In this case, the width of the partition portion between the adjacent pressure chambers of each passage group is set to be substantially equal to the width of the partition portion between the fluid resistance portion and the void. Such a configuration provides a uniform electric-field distribution around passages when the passages are formed by electroforming, etching, or any other suitable manufacturing method. As a result, unevenness in height between the partition portions formed by the electroforming method or the like is reduced.

Further, grinding and/or any other suitable processing for aligning the heights of the partition portions may be omitted, resulting in a reduction of the number of steps in the manufacturing process.

Further, in this configuration, the partition portions between passage groups, i.e., the partition portion 6*b* and the partition portion 7*b* are formed together to have a linear shape along the liquid flow direction of the passage. Such a configuration also provides a uniform electric-field distribution around each passage, and thus a uniform thickness of the passage plate when the passages are formed by the electroforming method or the like.

For example, when the passages are formed by an electroforming method, electric current may concentrate on a conductor portion having a higher curvature. As a result, the electric-field density generated around such a high-curvature conductor portion may become relatively high. In order to obtain a uniform thickness for the passage plate formed by the electroforming method, the electric-field density thereof should be kept as uniform as possible, and the line patterns in the electroforming should be as straight as possible.

Hence, in this exemplary embodiment, the partition portion between the adjacent passage groups is formed in a linear shape so that a uniform electric-field distribution is obtained around the partition portion. Thus, a uniform thickness is obtained for the passage plate formed by the electroforming method.

If all partition portions between the fluid resistance portions are provided with corresponding voids, the voids may form a considerably minute pattern. Such a configuration may increase the degree of difficulty in forming the partition portions and thus the incidence of failure in their formation. Also, such a configuration may generate an increased electric-field density around each void due to a high degree of concentration of the minute pattern. As a result, the partition portions between the fluid resistance portions may be undesirably formed in relatively great height compared to other partition portions.

Hence, in this exemplary embodiment, as illustrated in FIG. 6, each passage has a planar shape asymmetrical about a lengthwise center line Y1 of the liquid passage. The passage group has a planer shape symmetrical about a lengthwise center line Y2 of the passage group.

Further, as described above, a void is formed between the fluid resistance portions of each passage group whereas no such void is formed between the fluid resistance portions of the adjacent passage groups. Thus, a relatively large area is allocated to form the void. As a result, an increase in the size of void reduces the degree of concentration of the electric field around the fluid resistance portions.

As described above, in this exemplary embodiment, all the portions constituting the passage are formed with an identical member or material.

For example, when the passage including a pressure chamber, a fluid resistance portion, and a void is formed with an identical passage-forming member, high-precision bonding processing for bonding a plurality of passage-forming members may be omitted. As a result, the number of steps in the manufacturing and assembly process of the liquid ejection head can be reduced.

Alternatively, one passage may be formed with a plurality of passage-forming members. In such a case, however, high-precision bonding processing needs to be carried out while applying adhesive to respective surfaces of the plurality of passage-forming members. Such application of adhesive to the plurality of members may increase the amount of adhesive overflowing the bonding surface or surfaces thereof. Hence, in this exemplary embodiment, the void serving as a receiving portion of such adhesive overflow is formed at the partition portion having a relatively large area between the fluid resistance portions. Thus, the amount of adhesive overflowing the bonding surface can be reduced, and as a result ejection failure that might be caused by such overflowed adhesive can be prevented.

Figure 7:
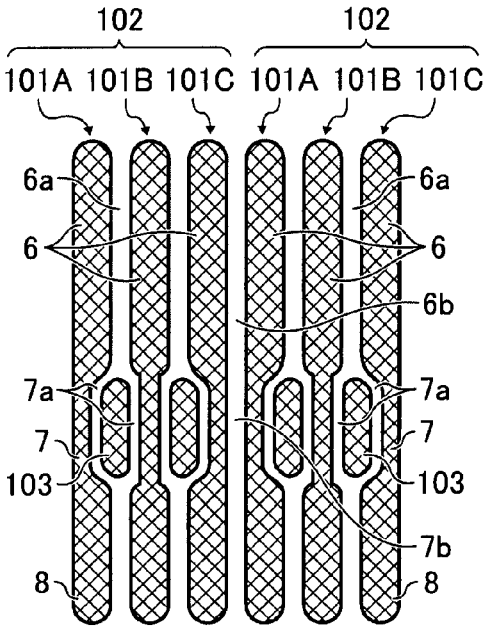
FIG. 7 is a plan view illustrating a passage pattern formed in a passage plate of a liquid ejection head according to another exemplary embodiment of the present disclosure.

Next, a liquid ejection head according to another exemplary embodiment of the present disclosure is described with reference to FIG. 7. FIG. 7 is a plan view illustrating a passage pattern formed in a passage plate of the liquid ejection head.

As illustrated in FIG. 7, a liquid ejection head 100 includes a plurality of passage groups 102. Each passage group 102 further includes passages 101A, 101B, and 101C. Each of the passages 101A, 101B, and 101C typically includes a pressure chamber 6 being communicated with orifices 4, a fluid resistance portion 7 having a width smaller than the width of the pressure chamber 6, and an inflow portion 8.

A given number of passages 101A, 101B, and 101C are arranged in the orifice array direction to form a plurality of passage groups 102. The passages 101A, 101B, and 101C are also arranged so that the pitch between the adjacent pressure chambers 6 of each passage group 102 is equal to the pitch between the adjacent pressure chambers 6 of the adjacent passage groups 102. In other words, the passages 101A, 101B, and 101C are arranged so that the width of the partition portion 6*a* may be equal to the width of the partition portion 6*b*.

As illustrated in FIG. 7, the fluid resistance portion 7 of the passage 101A is disposed to the left side thereof, the fluid resistance portion 7 of the passage 101B is disposed to the central portion thereof, and the fluid resistance portion 7 of the passage 101C is disposed to the right side thereof.

Thus, a relatively wide partition portion 7*a* may be obtained between the fluid resistance portion 7 of the passage 101B and each of the fluid resistance portions 7 of the passages 101A and 101C. In each partition portion 7*a*, a void 103 is formed by penetrating or partially removing the passage forming member. On the other hand, the void 103 is not formed in the partition portion 7*b* between the adjacent passage groups 102.

Partition portions 6*a* are formed between the three adjacent pressure chambers of each passage group 102 and a partition portion 6*b* is formed between the adjacent passage groups 102. Further, as described above, the partition portion 7*a* is formed between the fluid resistance portion 7 and the void 103 and the partition portion 7*b* is formed between the fluid resistance portions 7 of the adjacent passage groups 102. The partition portions 6*a*, 6*b*, 7*a*, and 7*b* are formed to have a substantially identical width.

Furthermore, in this configuration, the width of the partition portion between the adjacent pressure chambers of each passage group, the width of the partition portion between the adjacent pressure chambers of the adjacent passage groups, and the width of the partition portion between the fluid resistance portion and the void are formed to be substantially identical. As a result, a uniform thickness is obtained for the passage forming member, and thus the amount of adhesive overflowing the bonding surface can be reduced. However, in this exemplary embodiment, the maximum possible width of the fluid resistance portion 7 is relatively small compared to the exemplary embodiment illustrated in FIG. 6.

Figure 8:
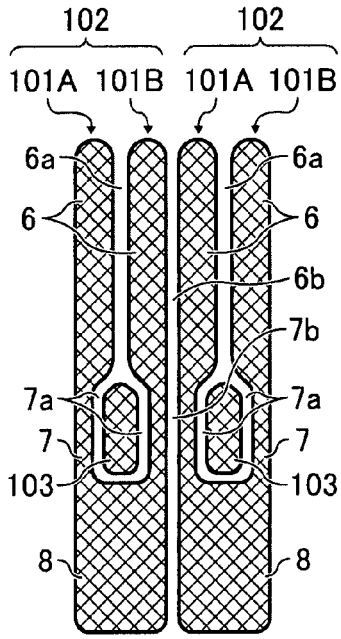
FIG. 8 is a plan view illustrating a passage pattern formed in a passage plate of a liquid ejection head according to another exemplary embodiment of the present disclosure.

Next, a liquid ejection head according to another exemplary embodiment of the present disclosure is described with reference to FIG. 8. FIG. 8 is a plan view illustrating a passage pattern formed in a passage plate of the liquid ejection head.

The passage pattern of FIG. 8 is similar in configuration to the passage pattern of FIG. 6. However, in FIG. 8, respective inflow portions of passage 101A and passage 101B forming each passage group 102 are in communication with each other and are integrally formed by providing one inflow portion 8.

Figure 9:
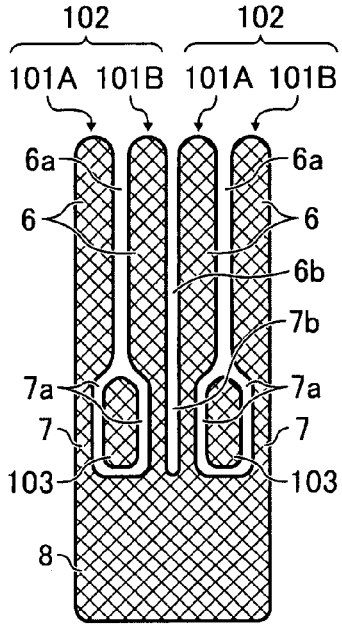
FIG. 9 is a plan view illustrating a passage pattern formed in a passage plate of a liquid ejection head according to another exemplary embodiment of the present disclosure.

Next, a liquid ejection head according to another exemplary embodiment of the present disclosure is described with reference to FIG. 9. FIG. 9 is a plan view illustrating a passage pattern formed in a passage plate of the liquid ejection head.

The passage pattern of FIG. 9 is similar in configuration to the passage pattern of FIG. 6. However, in FIG. 9, respective inflow portions of passages 101A and the passages 101B forming two adjacent passage groups 102 are in communication with each other and are integrally formed by providing one inflow portion 8.

Figure 10:
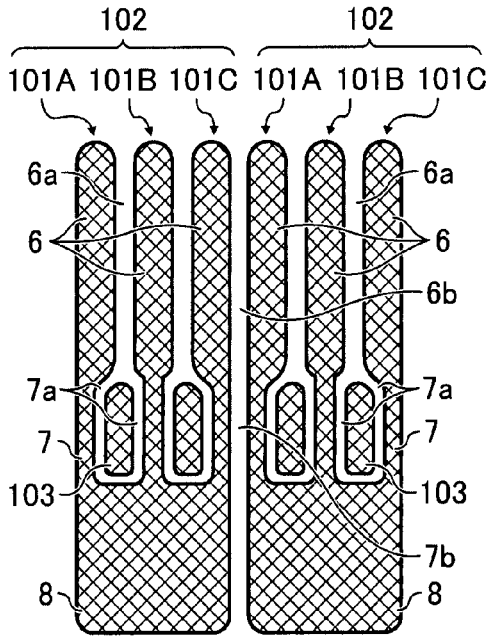
FIG. 10 is a plan view illustrating a passage pattern formed in a passage plate of a liquid ejection head according to another exemplary embodiment of the present disclosure.

Next, a liquid ejection head according to another exemplary embodiment of the present disclosure is described with reference to FIG. 10. FIG. 10 is a plan view illustrating a passage pattern formed in a passage plate of the liquid ejection head.

The passage pattern of FIG. 10 is similar in configuration to the passage pattern of FIG. 7. However, in FIG. 10, respective inflow portions of passages 101A, 101B, and 101C forming each passage group 102 are in communication with each other and are integrally formed by providing one inflow portion 8.

Figure 11:
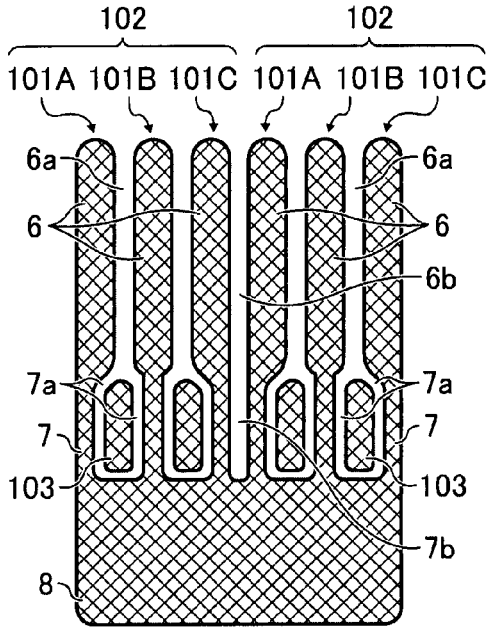
FIG. 11 is a plan view illustrating a passage pattern formed in a passage plate of a liquid ejection head according to another exemplary embodiment of the present disclosure.

Next, a liquid ejection head according to another exemplary embodiment of the present disclosure is described with reference to FIG. 11. FIG. 11 is a plan view illustrating a passage pattern formed in a passage plate of the liquid ejection head.

The passage pattern of FIG. 11 is similar in configuration to the passage pattern of FIG. 7. However, in FIG. 11, respective inflow portions of passages 101A, 101B, and 101C forming two adjacent passage groups 102 are in communication with each other and are integrally formed by providing one inflow portion 8.

Figure 12:
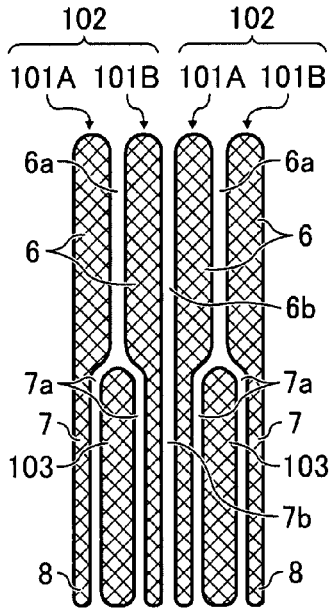
FIG. 12 is a plan view illustrating a passage pattern formed in a passage plate of a liquid ejection head according to another exemplary embodiment of the present disclosure.

Next, a liquid ejection head according to another exemplary embodiment of the present disclosure is described with reference to FIG. 12. FIG. 12 is a plan view illustrating a passage pattern formed in a passage plate of the liquid ejection head.

The passage pattern of FIG. 12 is similar in configuration to the passage pattern of FIG. 6. However, in FIG. 12, respective inflow portions 8 of passages 101A and 101B forming each passage group 102 are in communication with corresponding liquid-supply portions, not illustrated.

Figure 13:
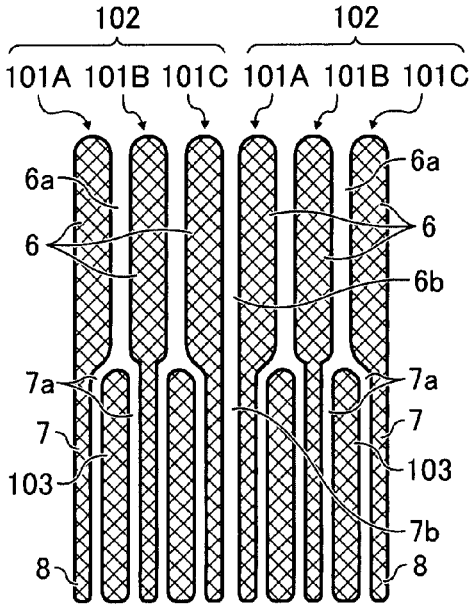
FIG. 13 is a plan view illustrating a passage pattern formed in a passage plate of a liquid ejection head according to another exemplary embodiment of the present disclosure.

Next, a liquid ejection head according to another exemplary embodiment of the present disclosure is described with reference to FIG. 13. FIG. 13 is a plan view illustrating a passage pattern formed in a passage plate of the liquid ejection head.

The passage pattern of FIG. 13 is similar in configuration to the passage pattern of FIG. 7. However, in FIG. 13, respective inflow portions 8 of passages 101A, 101B, and 101C forming each passage group 102 are in communication with corresponding liquid-supply portions, not illustrated.

Figure 14:
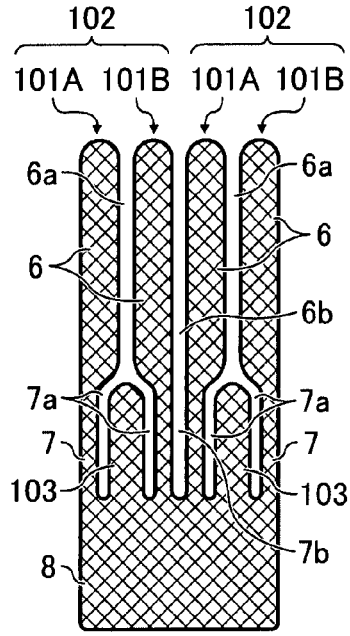
FIG. 14 is a plan view illustrating a passage pattern formed in a passage plate of a liquid ejection head according to another exemplary embodiment of the present disclosure.

Next, a liquid ejection head according to another exemplary embodiment of the present disclosure is described with reference to FIG. 14. FIG. 14 is a plan view illustrating a passage pattern formed in a passage plate of the liquid ejection head.

The passage pattern of FIG. 14 is similar in configuration to the passage pattern of FIG. 7. However, in FIG. 14, respective inflow portions of passages 101A and passages 101B forming two adjacent passage groups 102 are in communication with each other and are integrally formed by providing one inflow portion 8. Further, voids 103 are in communication with the inflow portion 8.

Pressure chambers 6 and fluid resistance portions 7 may have relatively great influence on the ejection properties of a liquid ejection head. Hence, similar to the passage pattern of FIG. 7, the pressure chambers 6 or the fluid resistance portions 7 in FIG. 14 are separated from each other. However, in FIG. 14, the fluid resistance portions 7 are in communication with a liquid-supply portion through the integrated inflow portion 8. Further, as described above, the voids 103 are also in communication with the integrated inflow portion 8.

In such a configuration, even when an adhesive overflowed from the bonding surface of the passage plate is received in the void 103, the influence of the adhesive on the ejection properties of the liquid ejection head may be suppressed. Further, since the voids 103 are in communication with the inflow portion 8, the passage pattern of FIG. 14 is advantageous from a manufacturing standpoint in that the separation of resist is easier to carry out when the passage pattern is formed by electroforming.

Figure 15:
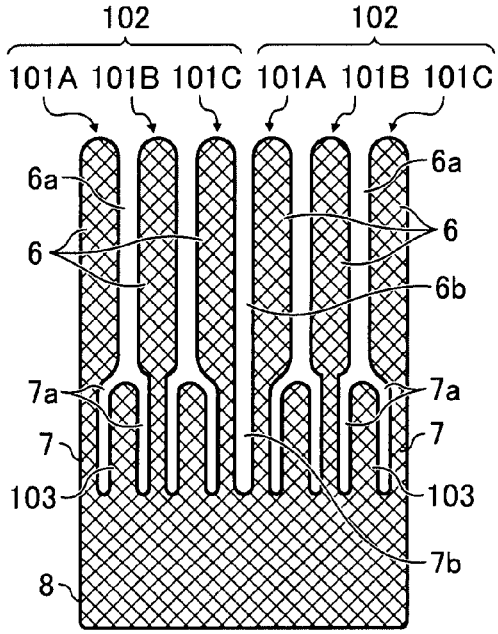
FIG. 15 is a plan view illustrating a passage pattern formed in a passage plate of a liquid ejection head according to another exemplary embodiment of the present disclosure.

Next, a liquid ejection head according to another exemplary embodiment of the present disclosure is described with reference to FIG. 15. FIG. 15 is a plan view illustrating a passage pattern formed in a passage plate of the liquid ejection head.

The passage pattern of FIG. 15 is similar in configuration to the passage pattern of FIG. 7. However, in FIG. 15, respective inflow portions of passages 101A, 101B, and 101C forming two adjacent passage groups 102 are in communication with each other and are integrally formed by providing one inflow portion 8. Further, in FIG. 15, voids 103 of the passage groups 102 are also in communication with the inflow portion 8.

Pressure chambers 6 and fluid resistance portions 7 may have relatively great influence on the ejection properties of the liquid ejection head. Hence, similar to the passage pattern of FIG. 7, the pressure chambers 6 or the fluid resistance portions 7 are separated from each other in the passage pattern of FIG. 15. However, in FIG. 15, the fluid resistance portions 7 are in communication with a liquid-supply portion through the inflow portion 8. Further, as described above, the voids 103 are also in communication with the inflow portion 8.

In such a configuration, even when an adhesive overflowing the bonding surface of the passage plate is received in the voids 103, the influence of the adhesive on the ejection properties of the liquid ejection head can be reduced. Further, since the voids 103 are in communication with the inflow portion 8, the passage pattern of FIG. 11 is advantageous in that the separation of resist is easier to accomplish when the passage pattern is formed by electroforming.

Figure 16A:
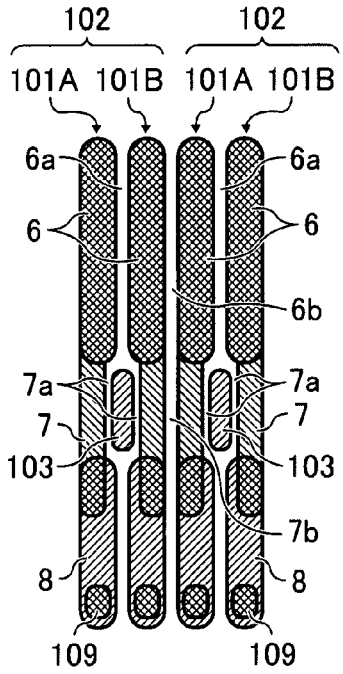
FIG. 16A is a plan view illustrating a passage pattern formed in a passage plate of a liquid ejection head according to another exemplary embodiment of the present disclosure.
Figure 16B:
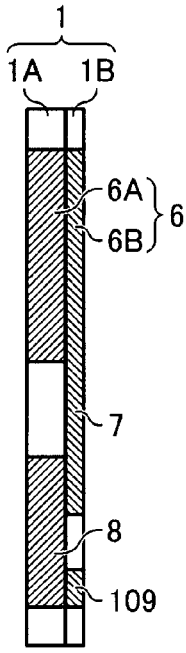
FIG. 16B is a cross-sectional side view of the passage plate of FIG. 16A.

Next, a liquid ejection head according to another exemplary embodiment is described with reference to FIGS. 16A and 16B. FIG. 16A is a plan view illustrating a passage pattern formed in a passage plate of the liquid ejection head. FIG. 16B is a cross-sectional side view of the passage plate of FIG. 16A.

In this exemplary embodiment, a passage plate 1 is formed of two plate-forming members 1A and 1B as illustrated in FIG. 16B. A pressure chamber 6 includes a penetration portion 6A formed in the plate member 1A and a penetration portion 6B formed in the plate member 1B. A fluid resistance portion 7 includes a penetration portion formed in the plate member 1B. An inflow portion 8 includes a penetration portion formed in the plate member 1A. Further, a liquid-supply portion 109 provided corresponding to the inflow portion 8 includes a penetration hole formed in the plate member 1B. In this case, the fluid resistance portion 7 in the plate member 1B is formed to have a height, a width, and a cross-sectional area of hollow portion smaller than a height, a width, and a cross-sectional area of the pressure chamber 6. Respective inflow portions 8 of passages 101A and 101B forming two adjacent passage groups 102 are separated from each other.

In FIGS. 16A and 16B, the portions formed in the plate member 1A are indicated by right-leaning hatching, the portions formed in the plate member 1B are indicated by left-leaning hatching, and the overlapping areas of the respective portions of the plate members 1A and 1B are indicated by cross-hatching.

Similar to the above-described exemplary embodiment illustrated in FIG. 6, the liquid ejection head includes passages 101A and 101B. Each of the passages 101A and 101B typically includes the pressure chamber 6, the fluid resistance portion 7 that supplies liquid to the pressure chamber 6 and has a width smaller than the width of the pressure chamber 6, and the inflow portion 8.

The adjacent two passages 101A and 101B form one passage group 102. In the passage plate 1, a given number of passages 101A and 101B are arranged in the orifice array direction to form a plurality of the passage groups 102. The passages 101A and 101B are also arranged so that the pitch between the adjacent pressure chambers 6 of each passage group 102 may be equal to the pitch between the adjacent pressure chambers 6 of the adjacent passage groups 102. In other words, the passages 101A and 101B are arranged so that the width of the partition portion 6*a* may be equal to the width of the partition portion 6*b*.

As illustrated in FIGS. 16A and 16B, the fluid resistance portion 7 of each passage 101A is disposed to the left side thereof and the fluid resistance portion 7 of each passage 101B is disposed to the right side thereof. Thus, a relatively wide partition portion 7*a* is obtained between the fluid resistance portions 7 of the passage 101A and 101B. Further, a void 103 may be formed in a portion of the plate member 1A corresponding to each partition portion 7*a*. Alternatively, the void 103 may be formed in portions of the plate members 1A and 1B corresponding to each partition portion 7*a*.

On the other hand, the void 103 is not formed in the partition portion 7*b* between the two adjacent passage groups 102.

In this case, a plurality of voids 103 may be formed at different plate members so as to securely obtain a receiving portion of the adhesive that might overflow the bonding surfaces when the plate-forming members 1A and 1B are joined together. Further, the use of a plurality of plate-forming members enables a configuration in which such voids are spaced apart from the fluid resistance portions.

Figure 17A:
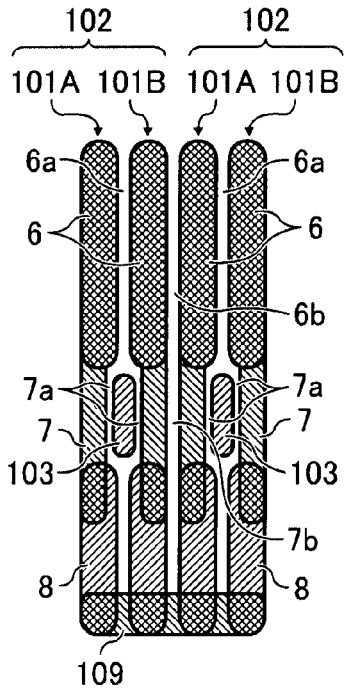
FIG. 17A is a plan view illustrating a passage pattern formed in a passage plate of a liquid ejection head according to another exemplary embodiment of the present disclosure.
Figure 17B:
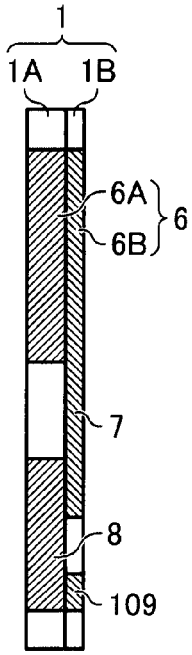
FIG. 17B is a cross-sectional side view of the passage plate of FIG. 17A.

Next, a liquid ejection head according to another exemplary embodiment is described with reference to FIGS. 17A and 17B. FIG. 17A is a plan view illustrating a passage pattern formed in a passage plate of the liquid ejection head. FIG. 17B is a cross-sectional side view of the passage plate of FIG. 17A.

The passage pattern of FIGS. 17A and 17B is similar in configuration to that of FIGS. 16A and 16B. However, in FIGS. 17A and 17B, respective liquid-supply portions of two adjacent passage groups 102 are in communication with each other and are integrally formed by providing one liquid-supply portion 109 having an increased area.

Figure 18A:
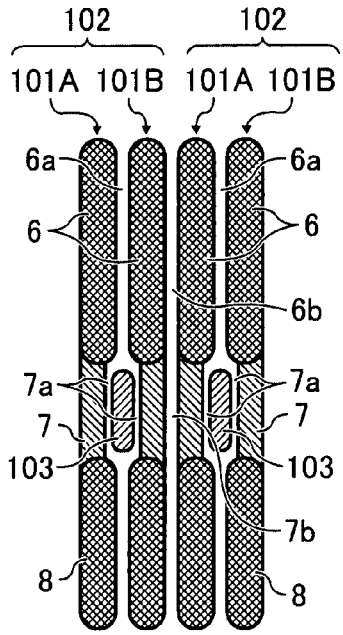
FIG. 18A is a plan view illustrating a passage pattern formed in a passage plate of a liquid ejection head according to another exemplary embodiment of the present disclosure.
Figure 18B:
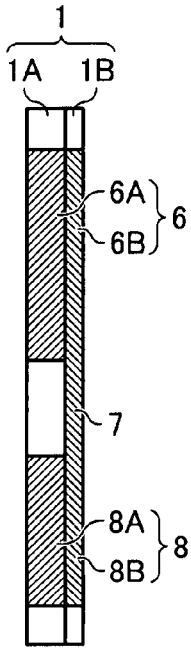
FIG. 18B is a cross-sectional side view of the passage plate of FIG. 18A.

Next, a liquid ejection head according to another exemplary embodiment of the present disclosure is described with reference to FIGS. 18A and 18B. FIG. 18A is a plan view illustrating a passage pattern formed in a passage plate of the liquid ejection head. FIG. 18B is a cross-sectional side view of the passage plate of FIG. 18A.

The passage pattern of FIGS. 18A and 18B is similar in configuration to that of FIGS. 16A and 16B. However, in FIGS. 18A and 18B, each inflow portion 8 includes a penetration portion 8A formed in a plate member 1A and a penetration portion 1B formed in a plate member 1B, and thus has a relatively great depth compared to the inflow portion 8 of FIGS. 16A and 163. In FIGS. 18A and 18B, the respective inflow portions 8 of passages 101A and 101B are separated from each other so that the fluid resistances thereof are reduced. In this case, a liquid-supply portion is provided to any other suitable member.

Figure 19A:
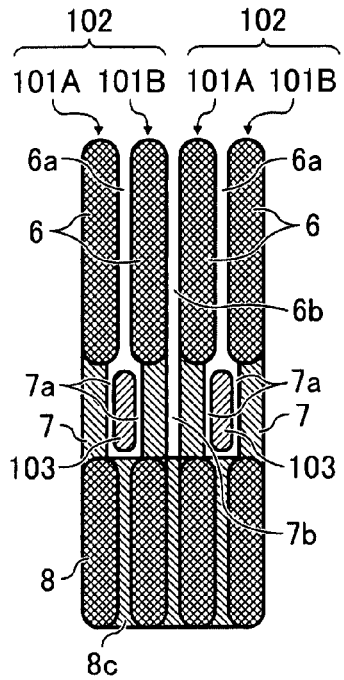
FIG. 19A is a plan view illustrating a passage pattern formed in a passage plate of a liquid ejection head according to another exemplary embodiment of the present disclosure.
Figure 19B:
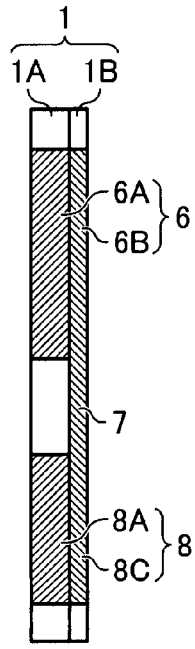
FIG. 19B is a cross-sectional side view of the passage plate of FIG. 19A.

Next, a liquid ejection head according to another exemplary embodiment of the present disclosure is described with reference to FIGS. 19A and 19B. FIG. 19A is a plan view illustrating a passage pattern formed in a passage plate of the liquid ejection head. FIG. 19B is a cross-sectional side view of the passage plate of FIG. 19A.

The passage pattern of FIGS. 19A and 19B is similar in configuration to the passage pattern of FIGS. 18A and 18B. However, in FIGS. 19A and 19B, a penetration portion 8C is formed in a plate member 1B so as to extend between a plurality of passage groups 102. Thus, the passages 101A and 101B of the plurality of passage groups 102 are partially in communication with each other through the inflow portions 8.

Figure 20:
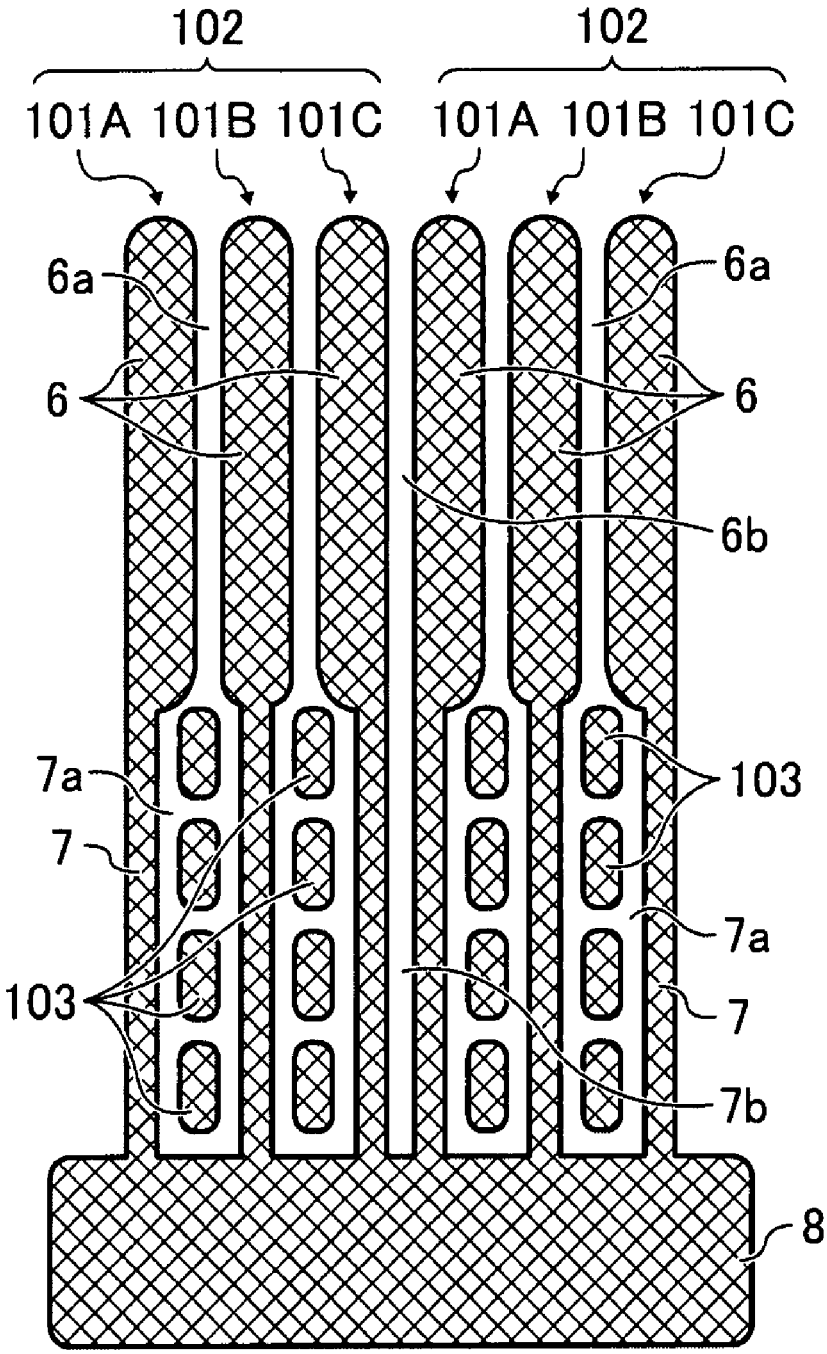
FIG. 20 is a plan view illustrating a passage pattern formed in a passage plate of a liquid ejection head according to another exemplary embodiment of the present disclosure.

Next, a liquid ejection head according to another exemplary embodiment of the present disclosure is described with reference to FIG. 20. FIG. 20 is a plan view illustrating a passage pattern formed in a passage plate of the liquid ejection head.

The passage pattern of FIG. 20 is similar in configuration to the passage pattern of FIG. 15. However, in the passage pattern of FIG. 20, a plurality of voids 103 are formed in each partition portion 7*a*. Such a configuration increases the rigidity of the partition portion 7*a*.

Figure 21A:
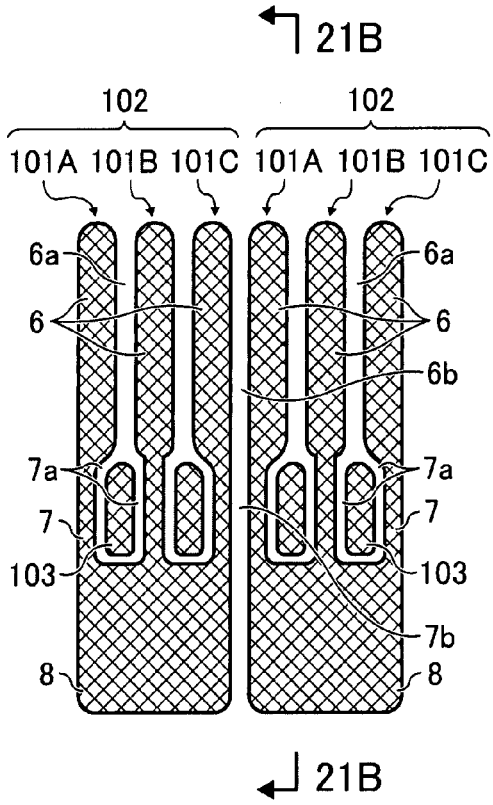
FIG. 21A is a plan view of the passage pattern of FIG. 10 illustrating the depth of a recess formed therein.
Figure 21B:
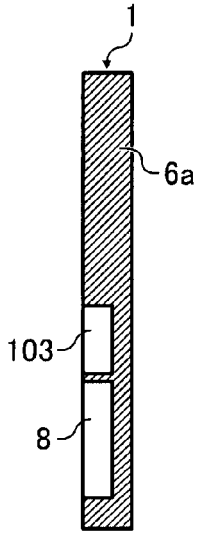
FIG. 21B is a cross-sectional side view of the passage plate of FIG. 10 taken along line A-A of FIG. 21A.
Figure 22A:
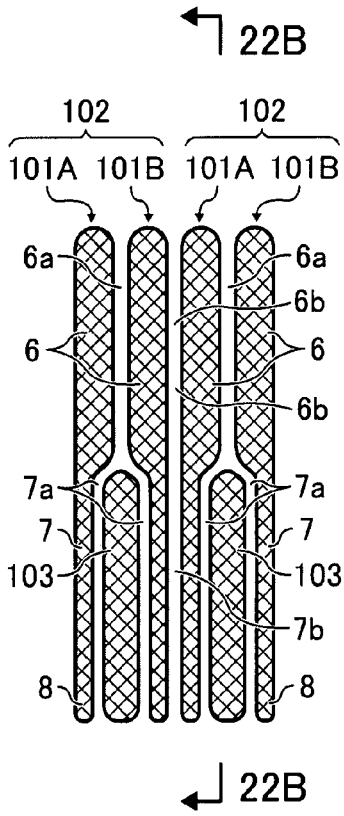
FIG. 22A is a plan view of the passage pattern of FIG. 12 illustrating the depth of a recess formed therein.
Figure 22B:
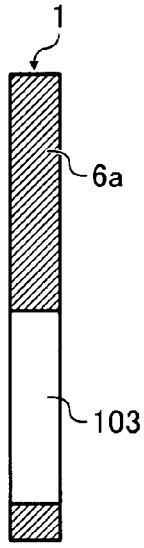
FIG. 22B is a cross-sectional side view of the passage plate of FIG. 12 taken along line B-B of FIG. 22A.

Next, examples of the shape of void 103 are described with reference to FIGS. 21A, 21B, 22A, and 22B. FIG. 21A is a plan view of the above-described passage pattern of FIG. 10 and FIG. 21B is a cross-sectional side view of FIG. 21A. FIG. 22A is a plan view of the above-described passage pattern of FIG. 12 and FIG. 22B is a cross-sectional side view of FIG. 22A.

As illustrated in FIG. 21A, for the passage pattern of FIG. 10, the partition portion 7*a* has one end integrally formed with the plate member 1, and the other end (on the side of the inflow portion 8) separated from the plate member 1 (hereinafter, "single-end support structure"). Hence, in order to increase the strength and/or rigidity of the partition portion 7*a*, the void 103 may be formed to have a bottom as illustrated in FIG. 21B by performing half-etching on the plate member 1.

On the other hand, as illustrated in FIG. 22A, in the passage pattern of FIG. 12, the partition portion 7*a* has both ends integrally formed with the plate member 1 (hereinafter, "double-end support structure"), and thus may obtain a relatively high strength and/or rigidity. Hence, in this configuration, the void 103 is formed to penetrate the plate member 1 as illustrated in FIG. 22B by performing full-etching on the plate member 1.

As described above, from the viewpoints of the strength and rigidity of the partition portion 7*a*, the void 103 may be preferably formed in a different shape corresponding to whether the partition portion 7*a* has a single-end support structure or a double-end support structure.

In the above-described exemplary embodiments, the fluid resistance portions are arrayed in one row in the passage array direction. However, the present disclosure is also applicable to a liquid ejection head having a configuration in which fluid resistance portions are arrayed in a plurality of rows in the direction in which liquid flows through the passage.

Next, other exemplary embodiments having such a configuration are described with reference to FIGS. 23 through 25.

First, a liquid ejection head according to another exemplary embodiment of the present disclosure is described with reference to FIG. 23. FIG. 23 is a plan view illustrating a passage pattern formed in a passage plate of the liquid ejection head.

In this embodiment, one passage group 102 includes a passage 101A and a passage 101B. Each of the passages 101A and 101B includes a fluid resistance portion 7 between a pressure chamber 6 and an inflow portion 8.

The fluid resistance portion 7 further includes a first fluid-resistance area 7A and a second fluid-resistance area 7B.

The first fluid-resistance area 7A has one end in communication with the pressure chamber 6 and the other end in communication with one end of the second fluid-resistance area 7B. The other end of the second fluid-resistance area 7B is in communication with the inflow portion 8.

Figure 23:
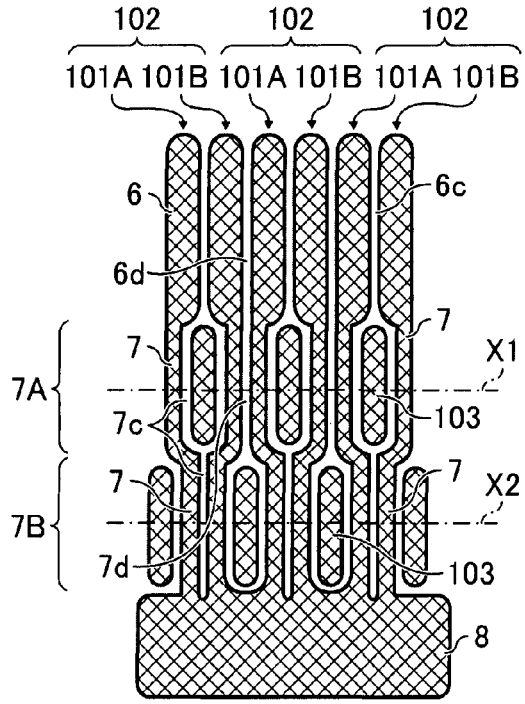
FIG. 23 is a plan view illustrating a passage pattern formed in a passage plate of a liquid ejection head according to another exemplary embodiment of the present disclosure.

As illustrated in FIG. 23, a partition portion 7*c* is formed to partition the adjacent fluid resistance portions 7 of each passage group 102. The partition portion 7*c* has a void 103 between the first fluid-resistance areas 7A of each passage group 102, and does not have a void 103 between the second fluid-resistance areas 7B thereof.

On the other hand, a partition portion 7*d* is formed to partition the adjacent fluid resistance portions 7 of the adjacent passage groups 102. The partition portion 7*d* does not have a void 103 between the first fluid-resistance areas 7A of the adjacent passage groups 102, and has a void 103 between the second fluid-resistance areas 7B thereof.

Thus, in the passage pattern of FIG. 23, along a line X1 in the passage array direction are alternately formed the partition portion 7*c* having the void 103 and the partition portion 7*d* not having the void 103.

Further, along a line X2 in the passage array direction are alternately formed the partition portion 7*c* not having the void 103 and the partition portion 7*d* having the void 103.

In other words, each of the partition portions 7*c* and 7*d* includes a portion having the void 103 and a portion not having the void 103.

Furthermore, in the passage pattern of FIG. 23, a partition portion 6*c* is formed between pressure chambers 6 of each passage group 102. Each partition portion 6*c* is integrally connected to the partition portion 7*c* and is configured to separate the pressure chambers 6.

Further, a partition portion 6*d* is formed between pressure chambers 6 of adjacent passage groups 102. The partition portion 6*d* is integrally connected to the partition portion 7*d* and is configured to separate the pressure chambers 6 of adjacent passage groups 102.

Thus, by adjusting the widths of the partition portions between the fluid resistance portions, a higher-density liquid ejection head is provided with a void serving as a receive portion for adhesive that might overflow the bonding surface of the passage plate. Further, an increase in the lengths of the fluid resistance portions may increase the fluid resistances thereof.

Next, a liquid ejection head according to another exemplary embodiment of the present disclosure is described with reference to FIG. 24. FIG. 24 is a plan view illustrating a passage pattern formed in a passage plate of the liquid ejection head.

Figure 24:
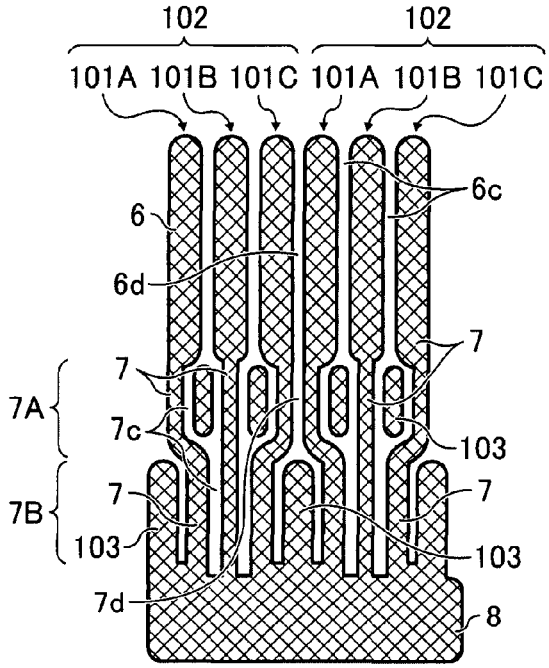
FIG. 24 is a plan view illustrating a passage pattern formed in a passage plate of a liquid ejection head according to another exemplary embodiment of the present disclosure.

The passage pattern of FIG. 24 is similar in configuration to the passage pattern of FIG. 23. However, in the passage pattern of FIG. 24, voids 103 corresponding to second fluid-resistance areas 7B are integrally formed with an inflow portion 8.

Next, a liquid ejection head according to another exemplary embodiment of the present disclosure is described with reference to FIG. 25. FIG. 25 is a plan view illustrating a passage pattern formed in a passage plate of the liquid ejection head.

Figure 25:
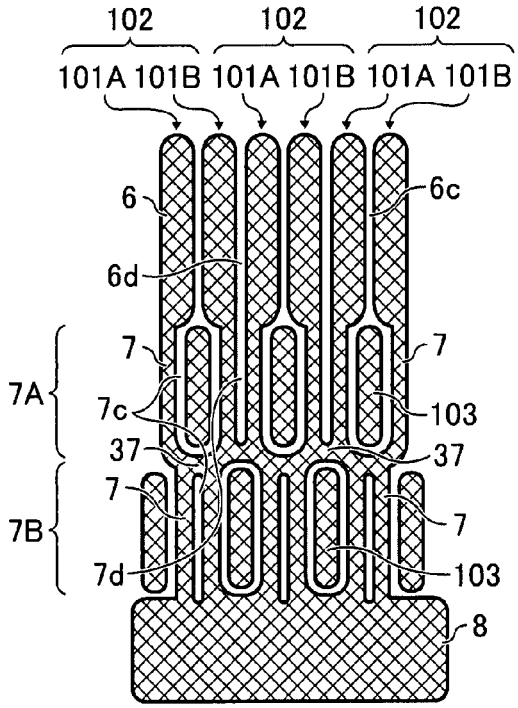
FIG. 25 is a plan view illustrating a passage pattern formed in a passage plate of a liquid ejection head according to another exemplary embodiment of the present disclosure.

The passage pattern of FIG. 25 is similar in configuration to the passage pattern of FIG. 23. However, in FIG. 25, fluid resistance portions 7 of a plurality of passage groups 102 are in communication with each other at the boundary between the first fluid-resistance portions 7A and the second fluid-resistance portions 7B through communication portions 37.

Figure 26:
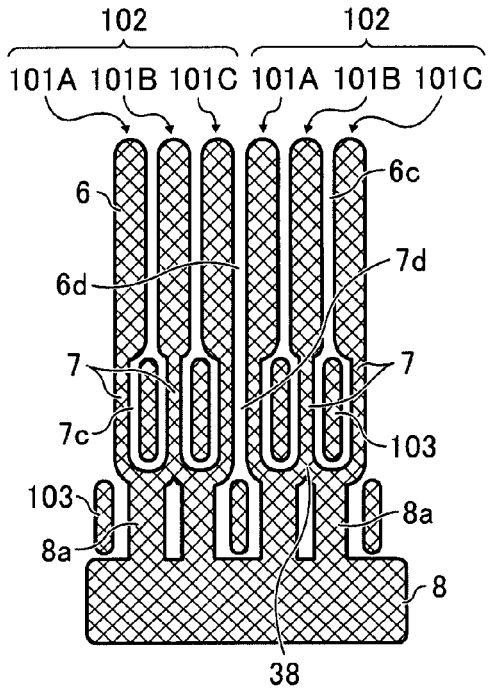
FIG. 26 is a plan view illustrating a passage pattern formed in a passage plate of a liquid ejection head according to another exemplary embodiment of the present disclosure.

Next, a liquid ejection head according to another exemplary embodiment of the present disclosure is described with reference to FIG. 26. FIG. 26 is a plan view illustrating a passage pattern formed in a passage plate of the liquid ejection head.

In this embodiment, fluid resistance portions 7 of a plurality of passage groups 102 are arrayed in one row in the direction in which passages 101A, 101B, and 101C are arrayed. As illustrated in FIG. 26, two adjacent fluid-resistance portions 7 in each passage group 102 are in communication with an inflow portion 8 through a portion 8*a* thereof. Further, the three fluid-resistance portions 7 in each passage group 102 are in communication with each other through a communication portion 38.

In the above-described exemplary embodiment, the passage plate, the orifice plate, and the vibration plate are configured as separate members.

However, the passage plate and the orifice plate may be integrally formed as a single member, or the passage plate and the vibration plate may be integrally formed as a single member.

Further, while a liquid ejection head according to the above-described exemplary embodiments takes the form of a piezoelectric liquid-ejection head, a liquid ejection head according to an exemplary embodiment of the present disclosure is applicable to a thermal liquid-ejection head using an electricity-to-heat converter or any other suitable type of liquid ejection head.

Next, an image forming apparatus including a liquid ejection device with a liquid ejection head according to an exemplary embodiment of the present disclosure is described with reference to FIGS. 27 and 28.

Figure 27:
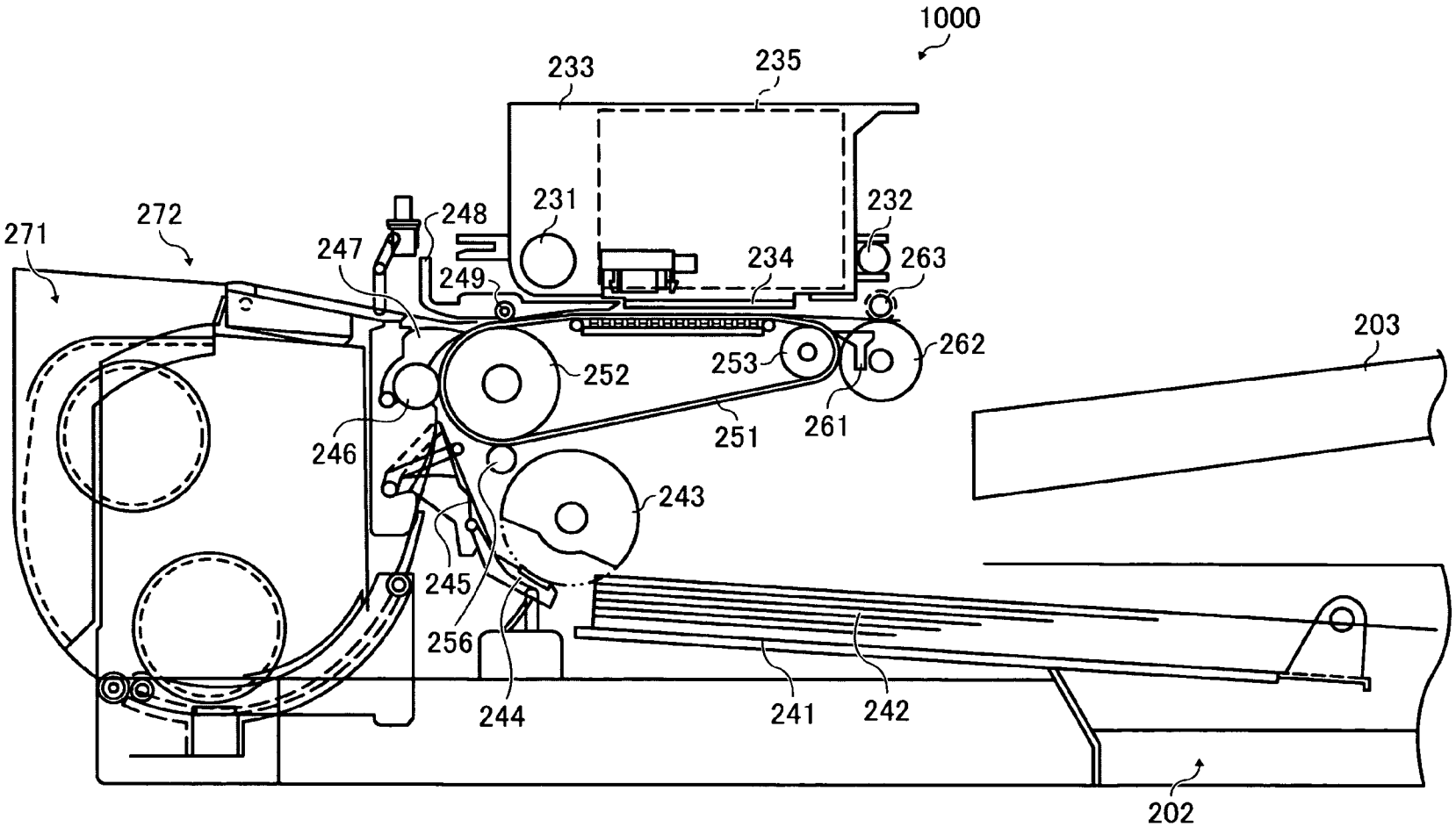
FIG. 27 is a side view illustrating a mechanical section of an image forming apparatus including a liquid ejection head according to another exemplary embodiment of the present disclosure.

FIG. 27 is a schematic view illustrating a general configuration of a mechanical section of the image forming apparatus. FIG. 28 is a plan view illustrating relevant portions of the mechanical section of FIG. 27.

Figure 28:
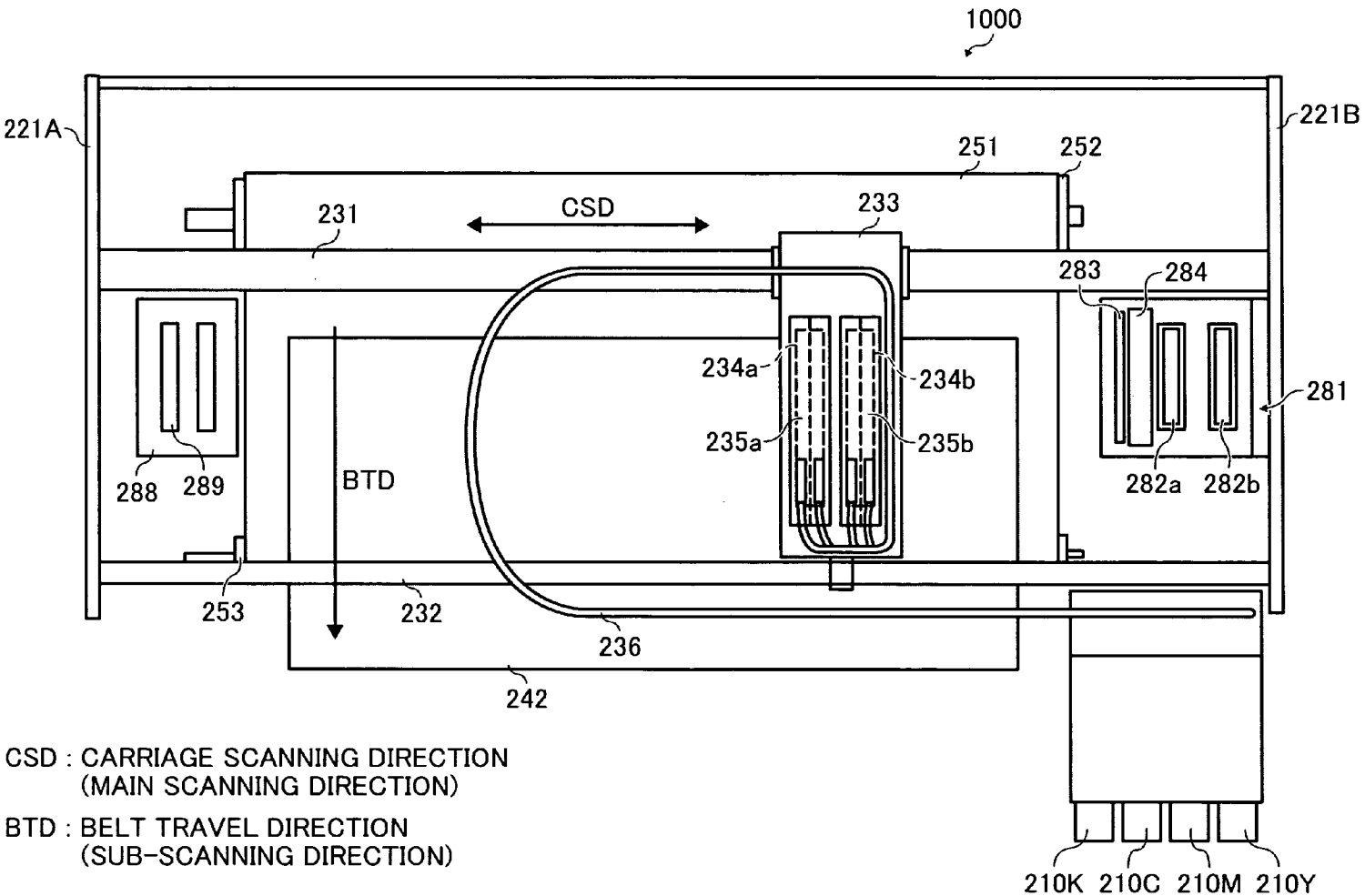
FIG. 28 is a plan view illustrating relevant portions of the mechanical section of the image forming apparatus of FIG. 27.

As illustrated in FIGS. 27 and 28, an image forming apparatus 1000 may be configured as a serial-type image forming apparatus.

In the image forming apparatus 1000, a carriage 233 is slidably supported by a primary guide rod 231 and a secondary guide rod 232 extending between side plates 221A and 221B.

The carriage 233 is driven by a main scanning motor to move in carriage travel directions (main scanning directions) indicated by a double arrow CSD in FIG. 28.

To the carriage 233 is mounted a recording head assembly 234 including two recording heads 234*a* and 234*b*. Each of the recording heads 234*a* and 234*b* is formed of a liquid ejection head according to an exemplary embodiment of the present disclosure. The recording heads 234*a* and 234*b* are configured to eject yellow (Y), cyan (C), magenta (M), and black (K) inks. In each of the recording heads 234*a* and 234*b*, one or more columns of orifices is arrayed in the sub-scanning direction indicated by an arrow BTD in FIG. 28. The recording heads 234*a* and 234*b* are also mounted to the carriage 233 so that ink droplets are ejected downward.

Each of the recording heads 234*a* and 234*b* may include two columns of orifices, for example. In such a case, the recording head 234*a* may have one column of orifices configured to eject ink droplets of K and the other column of orifices configured to eject ink droplets of C, and the recording head 234*b* may have one column of orifices configured to eject ink droplets of M and the other column of orifices configured to eject ink droplets of Y.

As illustrated in FIG. 28, to the carriage 233 may be mounted ink reservoirs 235*a* and 235*b* configured to store and supply respective color inks to the corresponding columns of orifices of the recording heads 234*a* and 234*b*. The respective color inks may be supplied and refilled from ink cartridges 210K, 210C, 210M, and 210Y to the ink reservoirs 235*a* and 235*b* through corresponding ink-supply tubes 236.

The image forming apparatus 1000 further includes a sheet feed section configured to feed sheets 242 stacked on a sheet stack portion or platen 241 of a sheet tray 202. As illustrated in FIG. 27, the sheet feed section may include a sheet feeding roller 243 to separate and feed the sheets 242 one by one from the sheet stack portion 241, and a separating pad 244 facing the sheet feeding roller 243 and made of a material having a relatively high coefficient of friction. The separating pad 244 is also configured to be biased toward the sheet feeding roller 243.

The image forming apparatus 1000 further includes a sheet conveyance section configured to convey the sheet 242, fed from the sheet feed section, under the recording head assembly 234.

As illustrated in FIG. 27, the sheet conveyance section may include a guide member 245 configured to guide the sheet 242, a counter roller 246, a conveyance guide member 247, a front-edge pressing member 248 having a front-edge pressing roller 249, and a conveyance belt 251 serving as a conveyor configured to convey the sheet 242, fed from the sheet feed section, to an area under the recording head assembly 234 while attracting the sheet 242 thereon by an electrostatic force.

The conveyance belt 251 may be formed in an endless shape as illustrated in FIG. 27. In this case, the conveyance belt 251 is extended between a conveyance roller 252 and a tension roller 253 so as to rotate in the belt travel direction (sub-scanning direction) indicated by the arrow BTD in FIG. 28.

The sheet conveyance section may further include a charging roller 256. The charging roller 256 is disposed in contact with the outer surface of the conveyance belt 251 so as to be rotationally driven by the rotation of the conveyance belt 251. The conveyance belt 251 rotationally moves in the belt travel direction when the conveyance roller 252 is rotationally driven by a sub-scanning motor via a timing belt and a timing roller.

Further, the image forming apparatus 1000 includes a sheet eject section configured to eject the sheet 242 having an image recorded by the recording head assembly 234 thereon. As illustrated in FIG. 27, the sheet eject section may include a separating claw 261 configured to separate the sheet 242 from the conveyance belt 251, sheet ejecting rollers 262 and 263, and a catch tray 203 disposed below the sheet ejecting roller 262.

Furthermore, a duplex sheet-feeding unit 271 may be detachably attached to the back of the image forming apparatus. The duplex sheet-feeding unit 271 receives the sheet 242 sent by the rotation of the conveyance belt 251 in a direction opposite to the belt travel direction Y in FIG. 28, conveys the sheet 242 in such a manner that the sheet 242 is turned upside down, and feeds the sheet 242 back between the counter roller 246 and the conveyance belt 261. A manual sheet-feeding tray 272 may be provided at the top of the duplex sheet-feeding tray 271.

As illustrated in FIG. 28, at a non-printing area on one side in the carriage travel direction X may be disposed a servicing unit 281 to maintain and restore the orifices of the recording head assembly 234 in and to good condition.

The servicing unit 281 may include cap members 282*a* and 282*b* configured to cover the respective orifice surfaces of the recording heads 234*a* and 234*b*, a wiper 283 configured to wipe or clean the orifice surfaces of the recording heads 234*a* and 234*b*, and an ink-receiving member 284 configured to receive ink droplets ejected from the orifices in what is called a "dummy-ejecting" operation. In such a dummy-ejecting operation, ink droplets are ejected for maintaining and/or restoring the orifices in good condition, not for forming an image.

At another non-printing area on the other side in the carriage travel direction X may be disposed an ink-receiving unit 288 serving as a container configured to receive ink droplets from the orifices in a dummy-ejecting operation in which, during an image forming operation, ink droplets are ejected for maintaining and/or restoring the orifices in good condition, not for forming an image. The ink-receiving unit 288 includes openings 289 arranged in the orifice array direction of each of the recording head 234*a* and 234*b*.

In the image forming apparatus 1000 thus configured, a sheet 242 is separated one by one from the sheet-feed tray 202, is fed upward in a substantially vertical direction, is guided by the guide member 245, and is conveyed while being sandwiched between the conveyance belt 251 and the counter roller 246. The front edge of the sheet 242 is also guided by the conveyance guide member 247, and is pressed by the front-edge pressing roller 249 toward the conveyance belt 251. Thus, the sheet 242 is forced to turn the conveyance direction by approximately 90 degrees.

In the meantime, the charging roller 256 is applied with alternate voltages so that positive and negative outputs are alternately repeated. As a result, on the conveyance belt 251 is formed an alternating charge-voltage pattern, that is, a band-shape charge pattern in which positive and negative polarities are alternately charged at a given width in the sub-scanning direction Y. When the sheet 242 is conveyed onto the conveyance belt 251 being alternately charged with positive and negative polarities, the sheet 242 is attracted onto the conveyance belt 251 by an electrical force, and is conveyed in the sub-scanning direction Y by the rotation of the conveyance belt 251.

When the sheet 242 is temporarily stopped on the conveyance belt 251, the recording head assembly 234 is driven based on image signals while the carriage 233 is being moved. Thus, the recording head assembly 234 ejects ink droplets onto the sheet 242 to record one line of a target image. When the sheet 242 on the conveyance belt 251 is fed by a given distance, the image forming apparatus 1000 starts an operation of recording another line of the target image. When receiving a recording-end signal or a signal indicating that the rear edge of the sheet 242 reaches the recording area, the image forming apparatus 1000 ends the image forming operation, and ejects the sheet 242 to the catch tray 203.

As described above, the image forming apparatus 1000 is provided with a liquid ejection head according to an exemplary embodiment of the present disclosure. Thus, the image forming apparatus 1000 may steadily provide a high-quality image with a high-density liquid ejection head.

In the above-described exemplary embodiment of the present disclosure, the image forming apparatus 1000 is described in the context of a printer. However, an image forming apparatus according to an exemplary embodiment of the present disclosure is not limited to such a printer, but may take the form of any other suitable type of image forming apparatus, such as a copier, a facsimile machine, or a multi-functional printer including functions thereof.

Further, an image forming apparatus according to an exemplary embodiment of the present disclosure may take the form of any other suitable type of image forming apparatus using a resist, a DNA sample, or a recording liquid other than ink.

Embodiments of the present disclosure may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. Embodiments of the present disclosure may also be implemented by the preparation of application specific integrated circuits or by interconnecting an appropriate network of conventional component circuits, as will be readily apparent to those skilled in the art.

Numerous additional modifications and variations are possible in light of the above teachings. It is therefore to be understood that, within the scope of the appended claims, the disclosure of this application may be practiced otherwise than as specifically described herein.

Further, elements and/or features of different exemplary embodiments and/or examples may be combined with each other and/or substituted for each other within the scope of this disclosure and appended claims.

Still further, any one of the above-described and other exemplary features of the present disclosure may be embodied in the form of an apparatus, method, system, computer program, or computer program product. For example, the aforementioned methods may be embodied in the form of a system or device, including, but not limited to, any of the structures for performing the methodology illustrated in the drawings.

Even further, any of the aforementioned methods may be embodied in the form of a program. The program may be stored on a computer readable medium and configured to perform any one of the aforementioned methods when run on a computer device (a device including a processor). Thus, the storage medium or computer readable medium can be configured to store information and interact with a data processing facility or computer device to perform the method of any of the above-described embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media (such as CD-ROMs and DVDs), magneto-optical storage media (such as MOs), magnetic storage media (including but not limited to floppy diskettes, cassette tapes, and removable hard disks), media with a built-in rewriteable non-volatile memory (including but not limited to memory cards), and media with a built-in ROM (including but not limited to ROM cassettes), etc. Furthermore, various information regarding stored images, for example, property information, may be stored in any other form, or provided in other ways.

Examples and embodiments being thus described, it should be apparent to one skilled in the art after reading this disclosure that the examples and embodiments may be varied in many ways. Such variations are not to be regarded as a departure from the spirit and scope of the present disclosure, and such modifications are not excluded from the scope of the following claims.

This disclosure claims priority under 35 U.S.C. §119 of Japanese Patent Applications No. JP2006-250488 filed on Sep. 15, 2006 and No. JP2007-191276 filed on Jul. 23, 2007 in the Japan Patent Office, the entire contents of which are hereby incorporated herein by reference.

What is claimed is:

1. A liquid ejection head, comprising:

a plurality of orifices configured to eject droplets of liquid;

a plurality of chambers in communication with the plurality of orifices;

a plurality of fluid resistance portions in communication with the plurality of chambers, each fluid resistance portion of the plurality of resistance portions having a smaller width than a width of each chamber of the plurality of chambers;

a plurality of passage groups arrayed in one direction, each passage group of the plurality of passage groups including at least two corresponding adjacent liquid passages, and each liquid passage of the at least two adjacent liquid passages in the passage group being formed by at least one chamber of the plurality of chambers and at least one fluid resistance portion of the plurality of the fluid resistance portions;

a plurality of first partitions, each specific first partition of the plurality of first partitions being configured to separate two adjacent liquid passages of a corresponding specific passage group of the plurality of passage groups and to separate adjacent fluid resistance portions of the respective adjacent liquid passages; and a plurality of second partitions, each specific second partition of the plurality of second partitions being configured of a material to separate adjacent passage groups of the plurality of passage groups and to separate adjacent fluid resistance portions in the respective adjacent passage groups, wherein the each specific first partition is provided with at least one void therein and the each specific second partition configured of the material is not provided with a void, and wherein for each specific first partition amongst the plurality of first partitions, there is at least one void between the adjacent fluid resistance portions separated by the specific first partition, and for each specific second partition amongst the plurality of second partitions, there is no void between the adjacent fluid resistance portions separated by the specific second partition.

2. A liquid ejection head according to claim 1, wherein, between the plurality of chambers, a pitch of the first partition is substantially identical to a pitch of the second partition.

3. A liquid ejection head according to claim 1, wherein the at least one void of the first partition is disposed between the plurality of fluid resistance portions.

4. A liquid ejection head according to claim 3, wherein a width of the first partition between the plurality of chambers, a width of the second partition between the plurality of chambers, and a width of the first partition between the at least one void and one of the plurality of fluid resistance portions are substantially identical.

5. A liquid ejection head according to claim 1, wherein the second partition has a linear shape extending in a direction in which the liquid flows through the liquid passage.

6. A liquid ejection head according to claim 5, wherein the liquid passage is asymmetrical about a lengthwise center line of the liquid passage, and the passage group is symmetrical about a lengthwise center line of the passage group.

7. A liquid ejection head according to claim 1, wherein the plurality of chambers, the plurality of fluid resistance portions, the plurality of liquid passages forming the plurality of passage groups, the plurality of first partitions, and the plurality of second partitions are formed in at least one material member.

8. A liquid ejection head according to claim 1, wherein the second partition not provided with the void has a linear shape extending a length adjacent to an adjacent chamber of the plurality of chambers and an adjacent fluid resistance portion of the plurality of the fluid resistance portions.

9. A liquid ejection head according to claim 1, wherein the first partition extends a length adjacent to an adjacent chamber of the plurality of chambers and an adjacent fluid resistance portion of the plurality of the fluid resistance portions.

10. An image forming apparatus comprising:

a liquid ejection head including:

a plurality of orifices configured to eject droplets of liquid;

a plurality of chambers in communication with the plurality of orifices;

a plurality of fluid resistance portions in communication with the plurality of chambers, each fluid resistance portion of the plurality of resistance portions having a smaller width than a width of each chamber of the plurality of chambers;

a plurality of passage groups arrayed in one direction, each passage group of the plurality of passage groups including at least two corresponding adjacent liquid passages, and each liquid passage of the at least two adjacent liquid passages in the passage group being formed by at least one chamber of the plurality of chambers and at least one fluid resistance portion of the plurality of the fluid resistance portions;

a plurality of first partitions, each specific first partition of the plurality of first partitions being configured to separate two adjacent liquid passages of a corresponding specific passage group of the plurality of passage groups and to separate adjacent fluid resistance portions of the respective adjacent liquid passages; and a plurality of second partitions, each specific second partition of the plurality of second partitions being configured of a material to separate adjacent passage groups of the plurality of passage groups and to separate adjacent fluid resistance portions in the respective adjacent passage groups; and a plurality of second partitions, each specific second partition of the plurality of second partitions being configured of a material to separate adjacent passage groups of the plurality of passage groups, wherein the each specific first partition is provided with at least one void therein and the each specific second partition configured of the material is not provided with a void, and wherein for each specific first partition amongst the plurality of first partitions, there is at least one void between the adjacent fluid resistance portions separated by the specific first partition, and for each specific second partition amongst the plurality of second partitions, there is no void between the adjacent fluid resistance portions separated by the specific second partition.

11. A liquid ejection head, comprising:

a plurality of orifices configured to eject droplets of liquid;

a plurality of chambers in communication with the plurality of orifices;

a plurality of fluid resistance portions in communication with the plurality of chambers, each fluid resistance portion of the plurality of fluid resistance portions having a smaller width than a width of each chamber of the plurality of chambers;

a plurality of passage groups arrayed in one direction, each passage group of the plurality of passage groups being formed by at least two corresponding adjacent liquid passages, and each liquid passage of the at least two adjacent liquid passages in the passage group being formed by at least one chamber of the plurality of chambers and at least one fluid resistance portion of the plurality of the fluid resistance portions;

a plurality of first partitions, each specific first partition of the plurality of first partitions being configured to separate two adjacent liquid passages of a corresponding specific passage group of the plurality of passage groups and to separate adjacent fluid resistance portions of the respective adjacent liquid passages; and a plurality of second partitions, each specific second partition of the plurality of second partitions being configured of a material to separate adjacent passage groups of the plurality of passage groups and to separate adjacent fluid resistance portions in the respective adjacent passage groups, wherein each of the first partitions includes a partition area having a void and a partition area not having a void between adjacent fluid resistance portions of the plurality of fluid resistance portions, wherein the each specific second partition configured of the material is not provided with a void, and wherein the partition areas having the voids in the plurality of first partitions and partition areas not having the voids in the plurality of second partitions are arrayed on a line extending in a direction in which the plurality of liquid passages are arrayed, and wherein for each specific first partition amongst the plurality of first partitions, there is at least one void between the adjacent fluid resistance portions separated by the specific first partition, and for each specific second partition amongst the plurality of second partitions, there is no void between the adjacent fluid resistance portions separated by the specific second partition.

* * * * *